US012038176B2

(12) United States Patent
Naik et al.

(10) Patent No.: US 12,038,176 B2
(45) Date of Patent: Jul. 16, 2024

(54) COUPLING A FUEL NOZZLE PURGE FLOW DIRECTLY TO A SWIRLER

(71) Applicant: General Electric Company, Schenectady, NY (US)

(72) Inventors: Pradeep Naik, Bengaluru (IN); Shai Birmaher, Cincinnati, OH (US); Kwanwoo Kim, Cincinnati, OH (US); Saket Singh, Bengaluru (IN); Perumallu Vukanti, Bengaluru (IN); Karthikeyan Sampath, Bengaluru (IN); Steven C. Vise, Loveland, OH (US); Nicholas R. Overman, Sharonville, OH (US); Michael A. Benjamin, Cincinnati, OH (US)

(73) Assignee: GENERAL ELECTRIC COMPANY, Cincinnati, OH (US)

( * ) Notice: Subject to any disclaimer, the term of this patent is extended or adjusted under 35 U.S.C. 154(b) by 162 days.

(21) Appl. No.: 17/651,644

(22) Filed: Feb. 18, 2022

(65) Prior Publication Data

US 2023/0266002 A1 Aug. 24, 2023

(51) Int. Cl.

| | |
|---|---|
| ***F23R 3/14*** | (2006.01) |
| ***F23R 3/28*** | (2006.01) |
| *F23D 11/38* | (2006.01) |

(52) U.S. Cl.

CPC ..... *F23R 3/14* (2013.01); *F23R 3/286* (2013.01); *F23D 11/383* (2013.01)

(58) Field of Classification Search

CPC ..... F23R 3/14; F23C 7/004; F23D 11/383

See application file for complete search history.

(56) References Cited

U.S. PATENT DOCUMENTS

| | | | |
|---|---|---|---|
| 6,035,645 | A | 3/2000 | Bensaadi et al. |
| 6,834,505 | B2 | 12/2004 | Al-Roub et al. |
| 7,013,649 | B2 | 3/2006 | Monty |
| 7,104,066 | B2 | 9/2006 | Leen et al. |
| 7,861,529 | B2 | 1/2011 | Commaret et al. |
| 7,891,190 | B2 | 2/2011 | Commaret et al. |
| 10,801,726 | B2 | 10/2020 | Stevens et al. |
| 2020/0248903 | A1* | 8/2020 | Sampath ..... F23R 3/14 |

FOREIGN PATENT DOCUMENTS

| | | |
|---|---|---|
| CN | 105716113 B | 3/2019 |
| EP | 3417208 B1 | 8/2020 |

* cited by examiner

*Primary Examiner* — Gerald L Sung
*Assistant Examiner* — Alyson Joan Harrington
(74) *Attorney, Agent, or Firm* — Venable LLP; Edward A. Kmett; Michele V. Frank

(57) ABSTRACT

A swirler assembly includes a swirler having a primary swirler with a primary swirler venturi, a swirler ferrule plate connected upstream to the primary swirler, and a fuel nozzle disposed in the swirler ferrule plate. The swirler ferrule plate has an annular pressure drop cavity with oxidizer inlet orifices in fluid communication with the swirler, and at least one outlet orifice in fluid communication with the primary swirler venturi. A second flow of oxidizer to the swirler incurs a first pressure drop, a third flow of the oxidizer from the swirler to the annular pressure drop cavity incurs a second pressure drop, and a fourth flow of the oxidizer from the annular pressure drop cavity to the primary swirler venturi incurs a third pressure drop.

20 Claims, 12 Drawing Sheets

COUPLING A FUEL NOZZLE PURGE FLOW DIRECTLY TO A SWIRLER

TECHNICAL FIELD

The present disclosure relates to providing a fuel nozzle purge flow to a primary swirler venturi for a swirler assembly in a combustor of a gas turbine engine.

BACKGROUND

Some conventional gas turbine engines are known to include rich-burn combustors that typically use a swirler integrated with a fuel nozzle to deliver a swirled fuel/air mixture to a combustor. A radial-radial swirler is one example of such a swirler and includes a primary radial swirler, a secondary radial swirler, and a swirler ferrule plate surrounding a fuel nozzle. The primary swirler includes a primary swirler venturi in which a primary flow of swirled air from the primary swirler mixes with fuel injected into the primary swirler venturi by the fuel nozzle. The swirler ferrule plate may include purge holes that provide a purge flow of air from a pressure plenum to the primary swirler venturi. The purge flow through the swirler ferrule plate is at a relatively high velocity as it exits the swirler ferrule plate into the primary swirler venturi.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Figure 1:
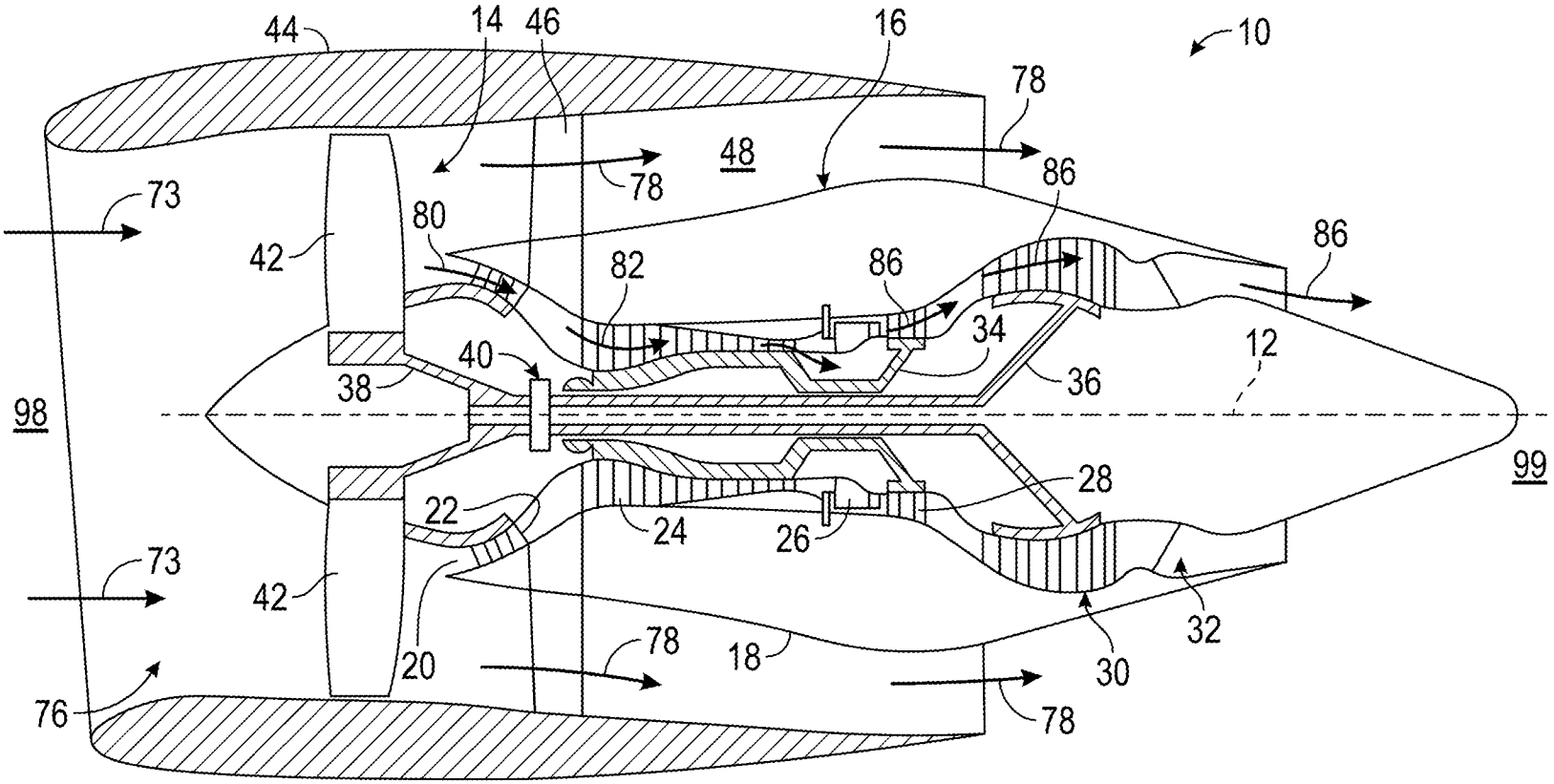
FIG. 1 is a schematic partial cross-sectional side view of an exemplary high by-pass turbofan jet engine, according to an aspect of the present disclosure.

Features, advantages, and embodiments of the present disclosure are set forth or apparent from a consideration of the following detailed description, drawings, and claims. Moreover, it is to be understood that the following detailed description is exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and the scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

In a rich-burn combustor that includes a radial-radial swirler, air is provided from a pressure plenum of the combustor to a primary radial swirler, where a swirl is induced in the air by swirl vanes in the primary swirler as it flows through the primary swirler. The primary swirler also includes a venturi and a fuel nozzle injects fuel into the venturi where it is mixed with the swirled air flow of the primary swirler. A swirler ferrule plate surrounds the fuel nozzle and may include purge holes that provide a purge flow of air from the pressure plenum to the venturi. The purge flow through the swirler ferrule plate is at a relatively high pressure and high exit velocity as it exits the swirler ferrule plate into the primary swirler venturi. The high velocity air stream from the ferrule plate directly interacts with the swirled air from of the primary swirler, which causes hydrodynamic instabilities and introduces higher perturbation in the flow of the primary swirler, particular before the fuel nozzle tip. These hydrodynamic instabilities drive instabilities in fuel distribution and heat release inside the combustor, leading to a higher than desired pressure inside the venturi.

The present disclosure addresses the foregoing to reduce the hydrodynamic instabilities and to keep the amplitude of pressure fluctuations within the venturi at a desired level or below a desired level. According to the present disclosure, a swirler ferrule plate includes an annular cavity that has inlet orifices coupled to an inlet portion of the swirler, and outlet orifices coupled to the swirler venturi. Pressurized air contained in a pressure plenum flows into the swirler where a first pressure drop is induced in the air flow. A portion of the air flow in the swirler is diverted from the swirler into the annular cavity of the swirler ferrule plate. This flow of the air incurs a second pressure drop, such that the pressure of the air inside the annular cavity is less than the pressure of the air in the swirler. The air in the annular cavity of the swirler ferrule plate then flows through the outlet orifices of the ferrule plate into the primary swirler venturi. This flow of the air incurs a third pressure drop, such that the pressure of the air flow into the venturi is less than the pressure of the air in the annular cavity. As a result, the pressure in the primary swirler venturi can be kept at a desired level or below a desired level and perturbations in the primary swirler air flow can be reduced. Thus, the present disclosure reduces the hydrodynamic instabilities that occur in the conventional ferrule plate.

Referring now to the drawings, FIG. 1 is a schematic partial cross-sectional side view of an exemplary high by-pass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, engine 10 has a longitudinal or axial centerline axis 12 that extends therethrough from an upstream end 98 to a downstream end 99 for reference purposes. In general, engine 10 may include a fan assembly 14 and a core engine 16 disposed downstream from the fan assembly 14.

The core engine 16 may generally include an outer casing 18 that defines an annular inlet 20. The outer casing 18 encases or at least partially forms, in serial flow relationship, a compressor section having a booster or low pressure (LP) compressor 22, a high pressure (HP) compressor 24, a combustor 26, a turbine section including a high pressure (HP) turbine 28, a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive configuration or a geared-drive configuration. In other embodiments, although not illustrated, the engine 10 may further include an intermediate pressure (IP) compressor and a turbine rotatable with an intermediate pressure shaft.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially spaced outlet guide vanes or struts 46. Moreover, at least a portion of the nacelle 44 may extend over an outer portion of the core engine 16 so as to define a bypass airflow passage 48 therebetween.

Figure 2:
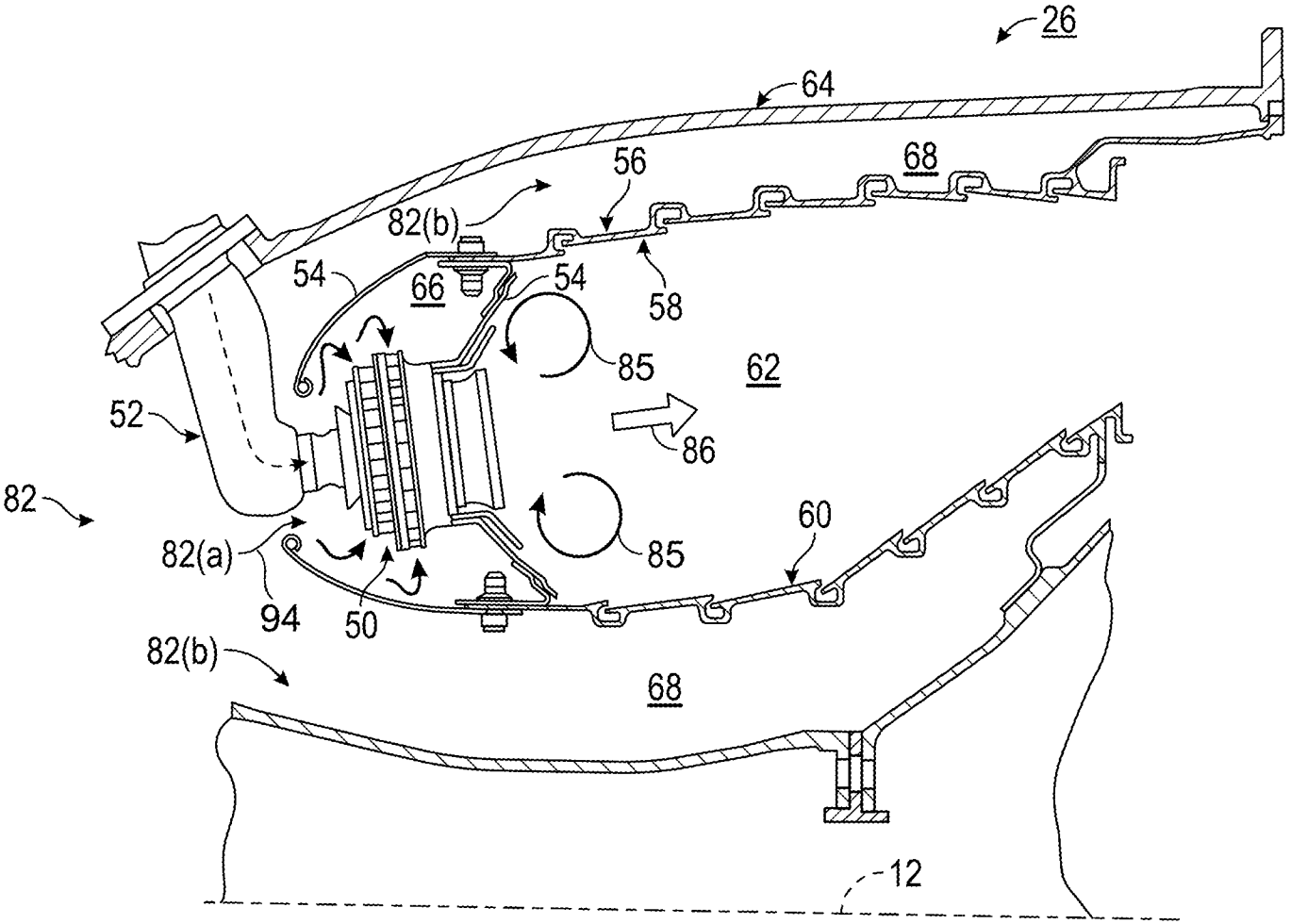
FIG. 2 is a partial cross-sectional side view of an exemplary combustion section, according to an aspect of the present disclosure.

FIG. 2 depicts an exemplary combustor 26 according to the present disclosure. In FIG. 2, combustor 26 includes a swirler assembly 50, fuel nozzle assembly 52, dome assembly 54, and an annular combustion liner 56 within outer casing 64. The annular combustion liner 56 includes an annular outer liner 58 and an annular inner liner 60 forming a combustion chamber 62 therebetween. A pressure plenum 66 is formed within the dome assembly 54. Referring back to FIG. 1, in operation, air 73 enters the nacelle 44, and a portion of the air 73 enters the compressor section (22/24) as compressor inlet air flow 80, where it is compressed. Another portion of the air 73 enters the bypass airflow passage 48 as a bypass airflow 78. In FIG. 2, compressed air 82 from the compressor section (22/24) enters the combustor 26 via a diffuser (not shown). A portion of the air 82(*a*) enters the dome assembly 54 to the pressure plenum 66, while another portion of the air 82(*b*) passes to an outer flow passage 68 between the annular combustion liner 56 and the outer casing 64. As will be described below, air 82(*a*) in the pressure plenum 66 passes through the swirler assembly 50 to mix with fuel ejected by the fuel nozzle assembly 52 and is ignited to generate combustion products 86.

Figure 3:
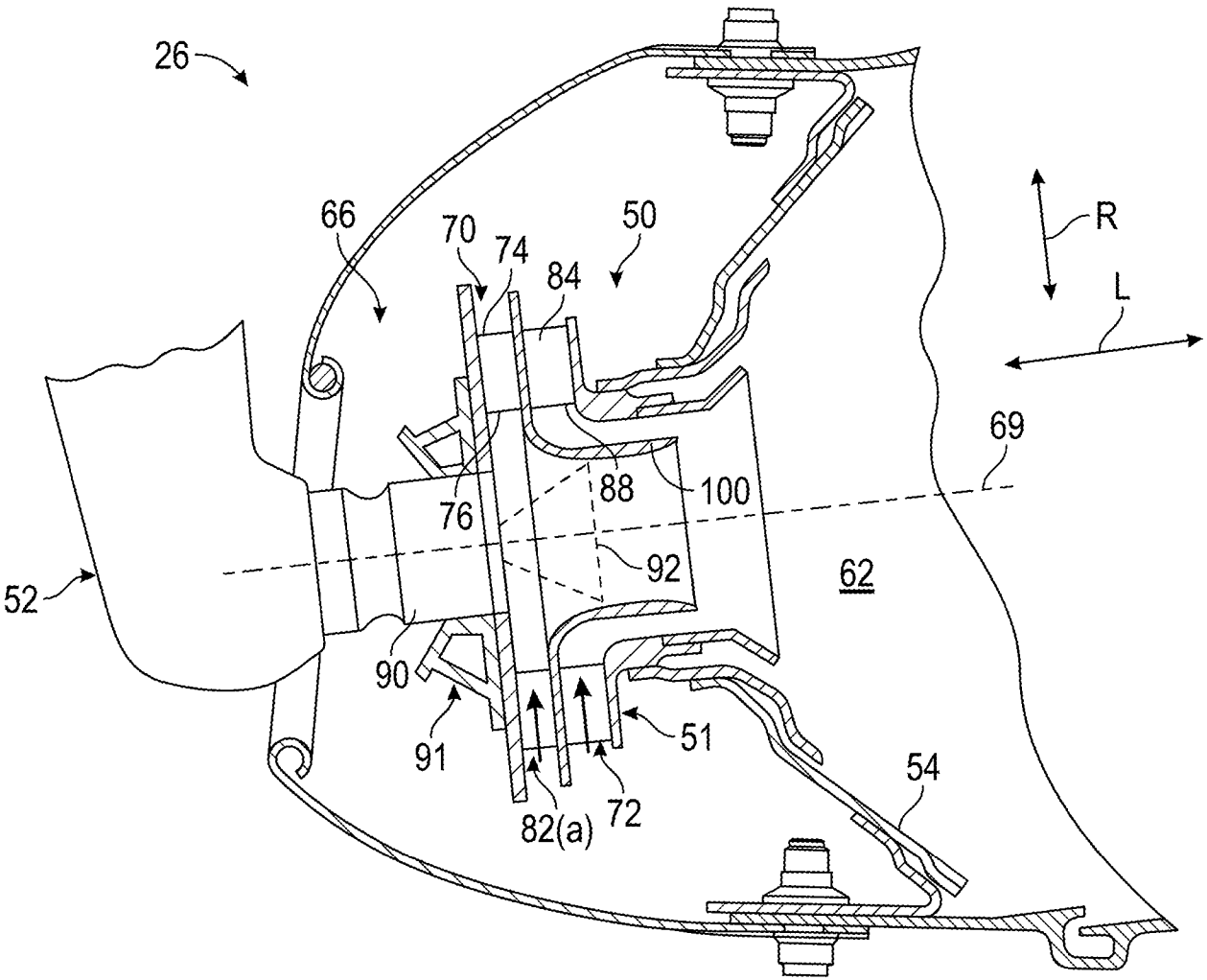
FIG. 3 is a partial cross-sectional side view of a forward portion of the exemplary combustion section of FIG. 2.
Figure 4:
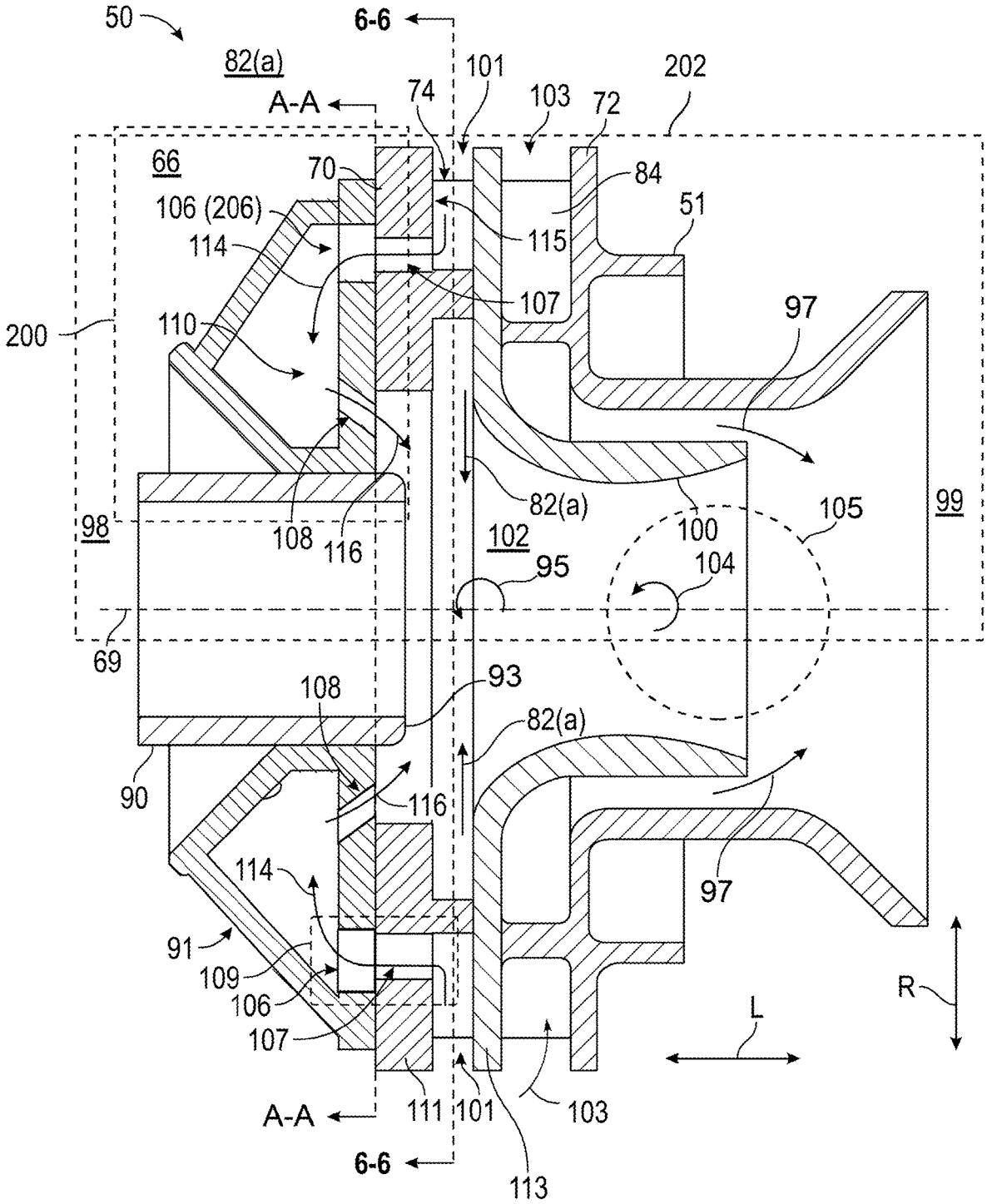
FIG. 4 is a partial cross-sectional side detail view of an exemplary fuel nozzle assembly, according to an aspect of the present disclosure.

Referring to FIGS. 3 and 4, FIG. 3 depicts a partial cross-sectional view of a forward portion of a combustor in the combustor 26, including swirler assembly 50, while FIG. 4 depicts a partial cross-sectional view of the swirler assembly 50. In FIG. 3, the combustor 26 defines its own longitudinal direction L relative to the engine centerline axis 12 and radial direction R relative the engine centerline axis 12. The swirler assembly 50 is symmetrical about swirler assembly centerline 69, which extends in the longitudinal direction L and is perpendicular to the radial direction R. The swirler assembly 50 is suitably connected to dome assembly 54. The swirler assembly 50 includes a swirler 51 and a fuel nozzle 90 disposed within the swirler 51. As will be described in more detail below, the swirler 51 includes a primary swirler 70 that includes a primary swirler venturi 100, a secondary swirler 72, and a swirler ferrule plate 91. The primary swirler 70 includes a plurality of primary swirler swirl vanes 74. The primary swirler swirl vanes 74 are circumferentially disposed in a row such that each of the primary swirler swirl vanes 74 extends radially inward to a primary swirler vane lip 76 (see, FIG. 6). The primary swirler swirl vanes 74 also extend longitudinally aft from a primary swirler forward wall 111. As will be described in more detail below, the primary swirler 70 includes a plurality of primary swirler oxidizer outlet orifices 107 through the primary swirler forward wall 111. The primary swirler 70 also includes primary swirler venturi 100 that extends in the longitudinal direction L concentrically about swirler assembly centerline 69. Thus, the primary swirler 70 is configured for swirling a corresponding portion of the pressurized air 82(*a*) from the pressure plenum 66 radially inwardly from the plurality of primary swirler swirl vanes 74 so as to generate a primary swirler swirled air flow 95 that is swirled in a primary swirl direction 104 within the primary swirler 70 (i.e., either clockwise about the swirler assembly centerline 69, or counter-clockwise circumferentially about swirler assembly centerline 69). Further, as will be explained in more detail below, a third flow 114 of the pressurized air 82(*c*) entering the primary swirler 70 is diverted through the primary swirler oxidizer outlet orifices 107 into an annular cavity 110 of the swirler ferrule plate 91.

The secondary swirler 72 similarly includes secondary swirler swirl vanes 84 that are circumferentially disposed in a row such that each of the secondary swirler swirl vanes 84 extends radially inward to a secondary swirler vane lip 88. The secondary swirler swirl vanes 84, similar to the primary swirler swirl vanes 74, extend longitudinally aft from a secondary swirler forward wall 113, which also forms a primary swirler aft wall of the primary swirler 70. Although not shown in FIG. 4, as will be described in more detail below with respect to FIG. 15, the secondary swirler 72 may include a plurality of oxidizer outlet orifices similar to the primary swirler oxidizer outlet orifices 107. Thus, the secondary swirler 72 is configured for swirling another corresponding portion of the pressurized air 82(*a*) from the pressure plenum 66 radially inward from the plurality of secondary swirler swirl vanes 84 of secondary swirler 72 so as to generate a secondary swirler swirled air flow 97.

The fuel nozzle assembly 52 is seen to include a fuel nozzle 90 disposed within the swirler ferrule plate 91 of the swirler 51. The fuel nozzle 90 shown in FIG. 4 is merely a general representation and other fuel nozzle components that may form the fuel nozzle 90 have been omitted. The fuel nozzle 90 injects a fuel 92 into a primary swirler venturi region 102 (FIG. 4) of the primary swirler venturi 100, where it is mixed with the primary swirler swirled air flow 95 from primary swirler 70 to generate a primary swirler fuel-air mixture 105. The primary swirler fuel-air mixture 105 in the venturi further mixes with the secondary swirler swirled air flow 97 from secondary swirler 72 downstream of the primary swirler venturi 100 to generate a mixer assembly fuel-air mixture 85 (FIG. 2) that is injected into the combustion chamber 62. The primary swirler venturi 100 radially separates the primary swirler swirled air flow 95 swirled from the primary swirler swirl vanes 74 from the secondary swirler swirled air flow 97 swirled from the secondary swirler swirl vanes 84.

Figure 5:
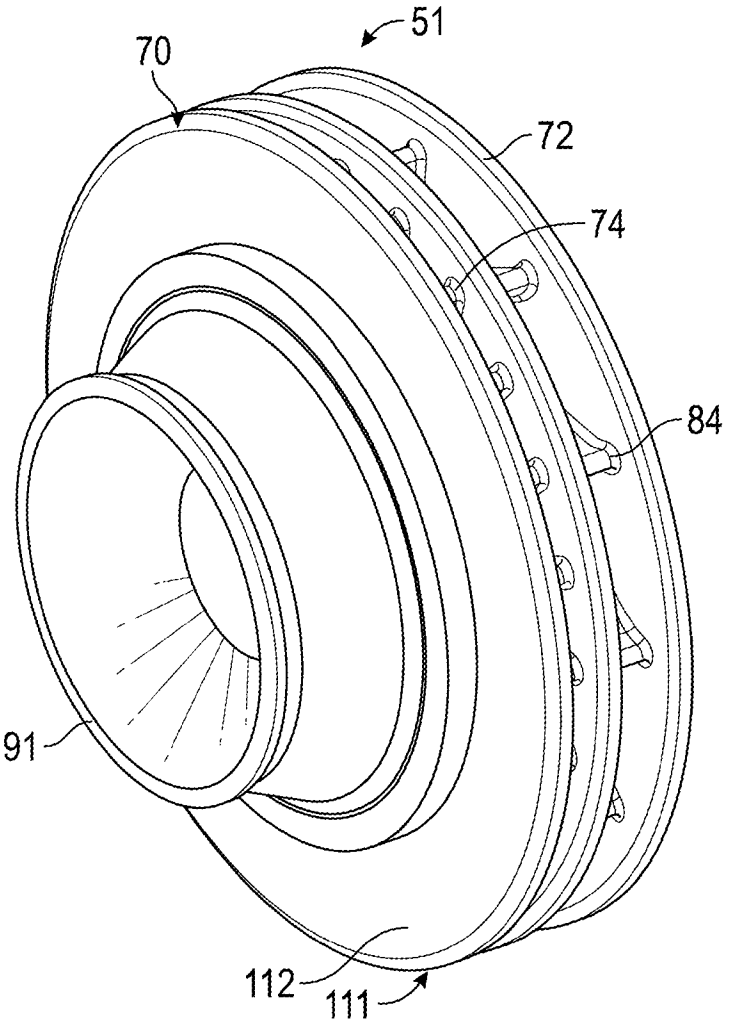
FIG. 5 is an aft-looking perspective view of an exemplary swirler assembly, according to an aspect of the present disclosure.

FIG. 5 is an aft-looking perspective view of swirler 51. The swirler 51 is seen to include the primary swirler 70, the secondary swirler 72, and the swirler ferrule plate 91. The fuel nozzle 90, which forms a part of the swirler assembly 50, is not depicted in FIG. 5. As was described above with regard to FIG. 4, the swirler ferrule plate 91 is connected to the primary swirler 70 at the upstream side 112 of the primary swirler forward wall 111. Various structural embodiments of the swirler ferrule plate 91 will be discussed in more detail below. Briefly, however, as illustrated in FIG. 4, swirler ferrule plate 91 includes an annular cavity 110 (which may also be referred to herein as "an annular pressure drop cavity"), a plurality of aft wall oxidizer inlet orifices 106 and at least one oxidizer outlet orifice 108. The plurality of aft wall oxidizer inlet orifices 106 provide fluid communication between the primary swirler 70 (or optionally, as described below with respect to FIG. 15, the secondary swirler 72) and the annular cavity 110, while the at least one oxidizer outlet orifice 108 provides fluid communication between the annular cavity 110 and the primary swirler venturi region 102 of the primary swirler 70.

Figure 6:
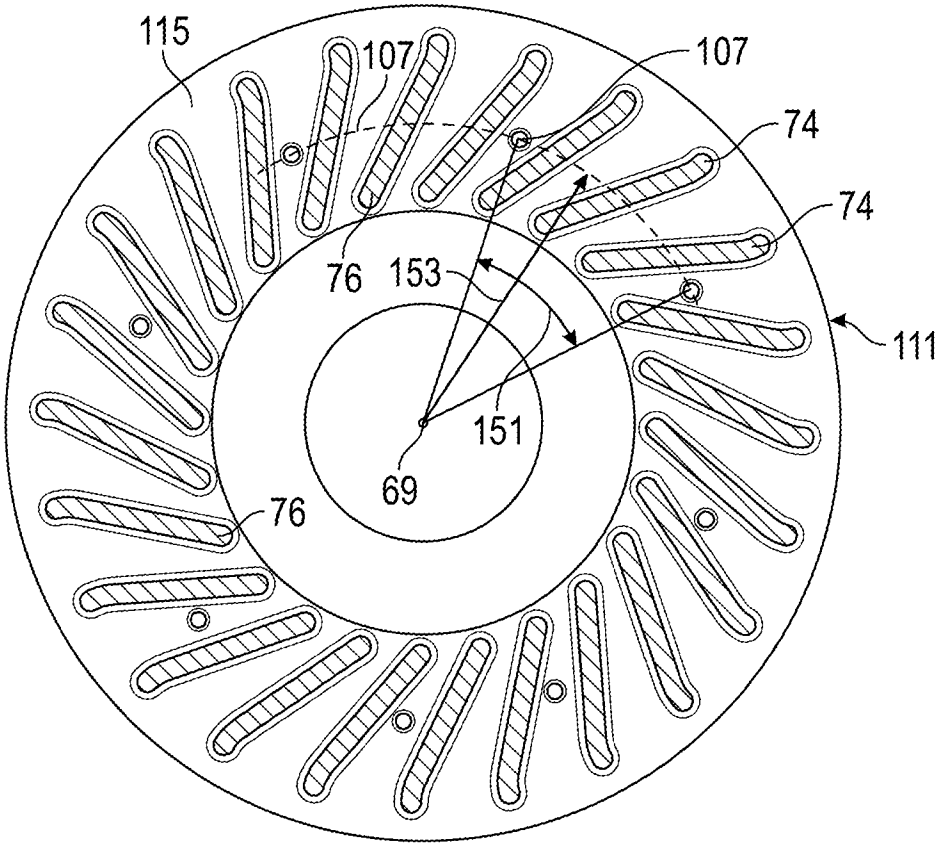
FIG. 6 is a partial cross-sectional view of a primary swirler taken at plane 6-6 of FIG. 4, according to an aspect of the present disclosure.

FIG. 6 is a partial cross-sectional forward-looking view of a primary swirler taken a plane 6-6 of FIG. 4. The cross section of FIG. 6 is taken through the primary swirler 70. As seen in FIG. 6, the primary swirler forward wall 111 includes a plurality of primary swirler oxidizer outlet orifices 107 therethrough. The primary swirler oxidizer outlet orifices 107 are seen to be disposed between two successive primary swirler swirl vanes 74. FIG. 6 depicts eight primary swirler oxidizer outlet orifices 107 arranged circumferentially at an angle 151 with respect to swirler assembly centerline 69, and at a radial distance 153 with respect to the swirler assembly centerline 69. While FIG. 6 depicts eight primary swirler oxidizer outlet orifices 107, more or fewer than eight of the primary swirler oxidizer outlet orifices 107 may be included instead. In addition, while the primary swirler oxidizer outlet orifices 107 in FIG. 6 are shown as being a generally circular shaped orifice (holes) or cylindrical holes through the primary swirler forward wall 111, other shapes may be used instead. Referring back to FIG. 4, each of the primary swirler oxidizer outlet orifices 107 is arranged with corresponding respective ones of the aft wall oxidizer inlet orifices 106 of the swirler ferrule plate 91. Together, a respective primary swirler oxidizer outlet orifice 107 and a respective aft wall oxidizer inlet orifice 106 are arranged together to form a ferrule oxidizer inlet orifice 109 (FIG. 4) that provides fluid communication between the primary swirler 70 and the annular cavity 110. That is, the primary swirler oxidizer outlet orifice 107 and the aft wall oxidizer inlet orifice 106 are generally aligned with one another to form a flow path (ferrule oxidizer inlet orifice 109) therethrough.

In operation, a first flow 94 of the compressed air 82(*a*) (FIG. 2) from the compressor section (22/24) is provided to the pressure plenum 66 via a diffuser (not shown), resulting in pressurized air 82(*a*) in the pressure plenum 66 being pressurized at a first pressure $P_1$. A second flow 101 of the pressurized air 82(*a*) (also referred to herein as an "oxidizer") flows from the pressure plenum 66 into the primary swirler 70. The second flow 101 incurs a first pressure drop $\Delta P_1$ in the primary swirler 70, where the first pressure drop $\Delta P_1$ is from a drop in pressure from the first pressure $P_1$ to a second pressure $P_2$ less than the first pressure $P_1$. As was described above, the primary swirler swirl vanes 74 induce a swirl in the second flow 101 to produce a primary swirled air flow 95 in the primary swirler venturi 100. In the present aspect, a third flow 114 of the oxidizer (air 82(*a*) 101) flowing through the primary swirler 70 flows through the plurality of primary swirler oxidizer outlet orifices 107 and through the plurality of aft wall oxidizer inlet orifices 106 (together forming the ferrule oxidizer inlet orifice 109) into the annular cavity 110 of the swirler ferrule plate 91. The third flow 114 into the annular cavity 110 incurs a second pressure drop $\Delta P_2$ from the second pressure $P_2$ to a third pressure $P_3$ that is lower than the second pressure $P_2$. Thus, the oxidizer within the annular cavity 110 is at the pressure $P_3$. A fourth flow 116 of the oxidizer contained within the annular cavity 110 then flows through the at least one oxidizer outlet orifice 108 into the primary swirler venturi region 102. The fourth flow 116 of the oxidizer through the at least one oxidizer outlet orifice 108 incurs a third pressure drop $\Delta P_3$ from the third pressure $P_3$ to a fourth pressure $P_4$ that is lower than the third pressure $P_3$. Thus, the total pressure drop $\Delta P_{TFP}$ through the swirler ferrule plate 91 may be defined as $\Delta P_{TFP}=\Delta P_2+\Delta P_3$, and the total pressure drop through the swirler 51, including the primary swirler 70 and the swirler ferrule plate 91, may be defined as $\Delta P_T=\Delta P_{TFP}+\Delta P_1$.

Figure 7:
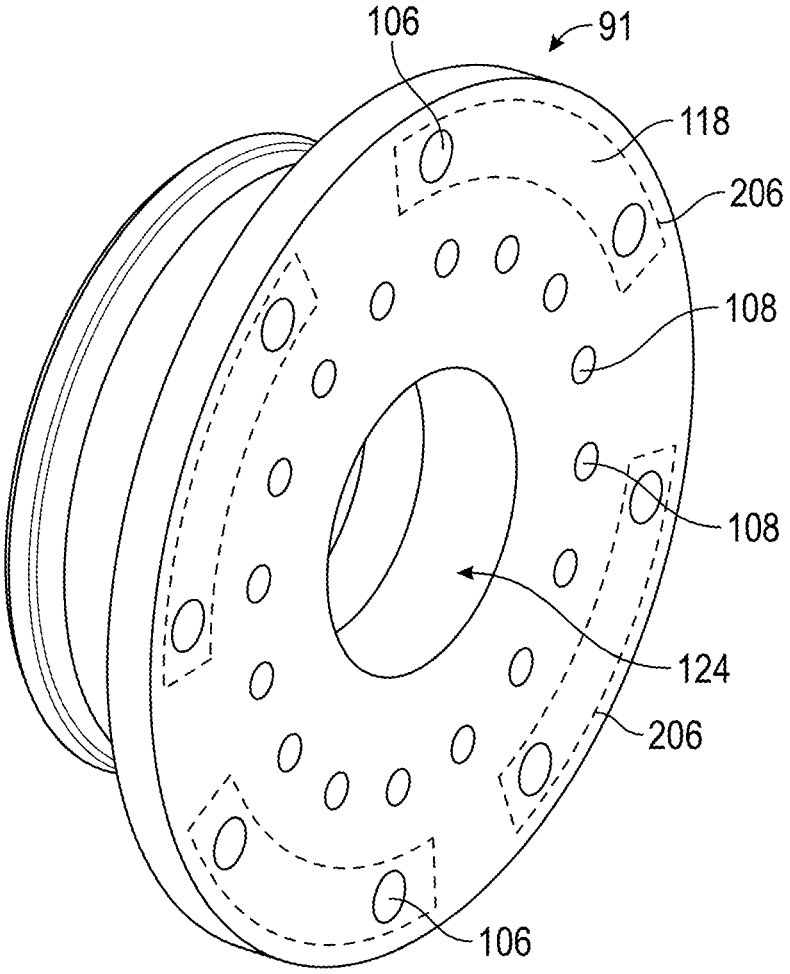
FIG. 7 is a forward-looking perspective view of an exemplary swirler ferrule plate, according to an aspect of the present disclosure.
Figure 8:
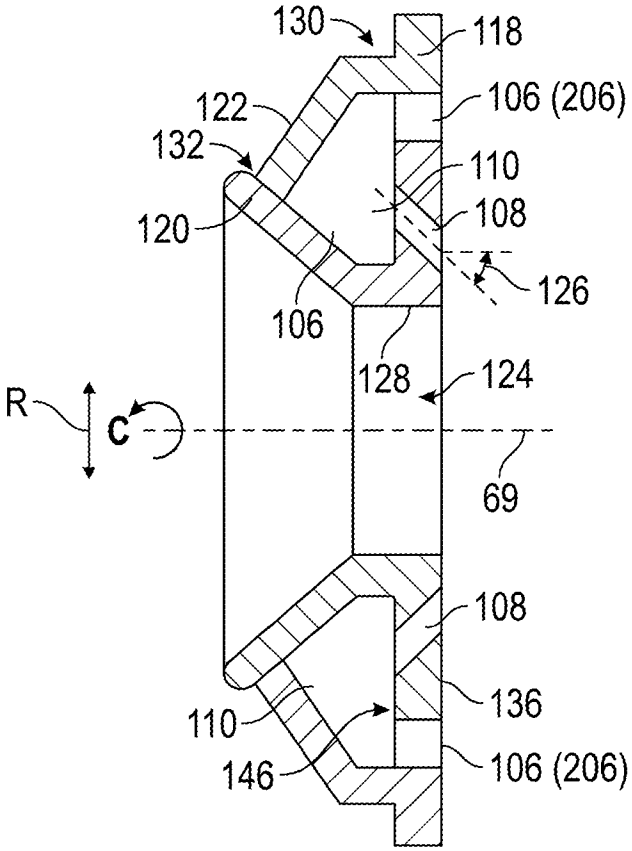
FIG. 8 is a partial cross-sectional side detail view of an exemplary swirler ferrule plate of FIG. 4, according to an aspect of the present disclosure.

FIG. 7 is a forward-looking perspective view of an exemplary swirler ferrule plate 91 according to an aspect of the present disclosure. FIG. 8 is a cross-sectional view of the exemplary swirler ferrule plate 91 as seen in FIG. 4. Swirler ferrule plate 91 is seen to include an aft wall 118 that extends radially outward in radial direction R from swirler assembly centerline 69, and also extends circumferentially about the swirler assembly centerline 69 (see FIG. 9). A fuel nozzle opening 124 is defined through the aft wall 118. As was shown in FIG. 4, as part of the swirler assembly 50, the fuel nozzle 90 is disposed in the fuel nozzle opening 124 of the swirler ferrule plate 91. While aft wall 118 is depicted as being a generally cylindrical wall, the aft wall 118 is not limited to being cylindrical and may be other shapes, such as square, rectangular, hexagonal, etc., instead.

The swirler ferrule plate 91 also includes an annular conical wall 120 and an annular cavity wall 122. The annular conical wall 120 extends radially outward and upstream from a radially inward portion 128 of the aft wall 118 at the fuel nozzle opening 124, and upstream from the radially inward portion 128 of the aft wall 118 at the fuel nozzle opening 124. The annular conical wall 120 also extends circumferentially about swirler assembly centerline 69, thereby forming a radially inward conical opening in an upstream end of the fuel nozzle opening 124. The annular cavity wall 122 is connected to a radially outward portion 130 of the aft wall 118 and an upstream end 132 of the annular conical wall 120. The annular cavity wall 122 extends circumferentially about swirler assembly centerline 69. Thus, the aft wall 118, the annular conical wall 120, and the annular cavity wall 122 form the annular cavity 110.

The plurality of aft wall oxidizer inlet orifices 106 are formed through the aft wall 118. As was discussed above, the aft wall oxidizer inlet orifices 106 have a corresponding primary swirler oxidizer outlet orifice 107 of the primary swirler 70 that, together, form the ferrule oxidizer inlet orifice 109, which provides fluid communication between the primary swirler 70 and the annular cavity 110. The plurality of aft wall oxidizer inlet orifices 106 and the plurality of primary swirler oxidizer outlet orifices 107 may have different shapes and/or sizes. The size, shape, and/or number of the plurality of aft wall oxidizer inlet orifices 106, the size, shape, and/or number of the plurality of primary swirler oxidizer outlet orifices 107, the size/shape of the annular cavity 110, and the size, shape, and number of the at least one oxidizer outlet orifice 108 may all be configured to obtain a desired $\Delta P_2$, $\Delta P_3$ and $\Delta P_{TFP}$. In some exemplary embodiments, the arrangement (e.g., size, shape and number) of the plurality of aft wall oxidizer inlet orifices 106, the arrangement (e.g., size, shape, and number) of the plurality of primary swirler oxidizer outlet orifices 107, and the arrangement (e.g., size and shape) of the annular cavity 110 may be such as to provide a $\Delta P_2$ that is between ten percent and ninety percent of the $\Delta P_{TFP}$. The arrangement (e.g., size and shape) of the annular cavity 110 and the arrangement (e.g., size, shape, and number) of the at least one oxidizer outlet orifice 108 may be such as to provide a $\Delta P_3$ that constitutes a remaining portion (percentage) of the $\Delta P_{TFP}$.

The aft wall oxidizer inlet orifices 106 and the primary swirler oxidizer outlet orifices 107 shown in FIGS. 7 and 8 are shown as being generally circular shaped holes. However, the aft wall oxidizer inlet orifices 106 and/or the primary swirler oxidizer outlet orifices 107 may, instead, include other shaped holes, such as triangular holes, trapezoidal shaped holes, oval shaped holes, rectangular shaped holes, etc. In addition, the combination of a respective aft wall oxidizer inlet orifice 106 and a respective primary swirler oxidizer outlet orifice 107 form a ferrule oxidizer inlet orifice 109 may be straight through aligned holes, or alternatively, may be tapered. For example, the ferrule oxidizer inlet orifices 109 may have a smaller size on the inlet side of the orifice (i.e., at the aft surface 115 (FIG. 4) of the primary swirler forward wall 111) and have a larger size on the outlet side of the orifice (i.e., at forward surface 146 (FIG. 8) of the aft wall 118). Alternatively, the ferrule oxidizer inlet orifices 109 may have a larger size on the inlet side and have a smaller size on the outlet side.

Figure 9:
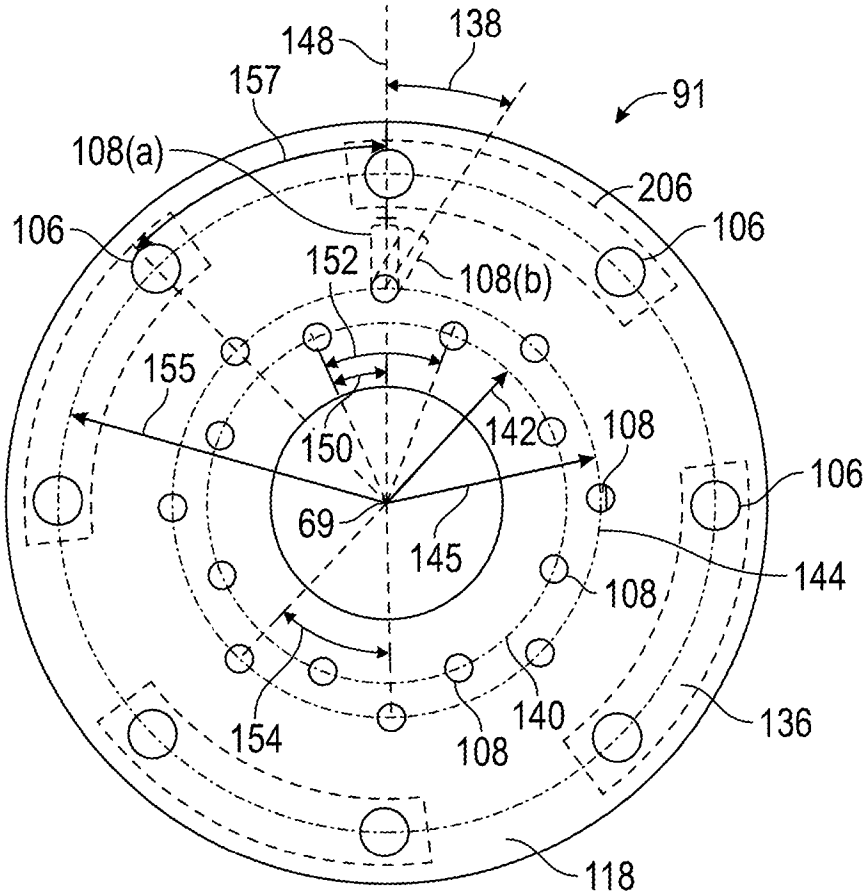
FIG. 9 is an aft forward-looking elevational view of an exemplary swirler ferrule plate, according to an aspect of the present disclosure.

In another aspect, the aft wall oxidizer inlet orifices 106 may be formed as slotted oxidizer inlet orifices 206 (see, FIG. 9) that extend circumferentially through the aft wall 118, with a center of each of the slotted oxidizer inlet orifices 206 being arranged at the radial distance 155. A height of the slotted oxidizer inlet orifices 206 may be the same as the size (e.g., diameter) of the aft wall oxidizer inlet orifices 106, or as seen in FIG. 9, the height may be slightly larger than the aft wall oxidizer inlet orifices 106. With the slotted oxidizer inlet orifices 206, one slotted oxidizer inlet orifice 206 may be arranged with multiple primary swirler oxidizer outlet orifices 107, so as to provide the fluid communication between the primary swirler 70 and the swirler ferrule plate 91.

FIG. 9 is an aft forward-looking view of the swirler ferrule plate 91 depicting an arrangement of both the aft wall oxidizer inlet orifices 106 and the at least one oxidizer outlet orifice 108 through the aft wall 118. The aft wall oxidizer inlet orifices 106 are seen to be arranged circumferentially about swirler assembly centerline 69, and may be arranged at a radial distance 155 from the swirler assembly centerline 69. In addition, the circumferential spacing of the aft wall oxidizer inlet orifices 106 may be at an angle 157. The radial distance 155 and the angle 157 of the aft wall oxidizer inlet orifices 106 correspond to the radial distance 153 and the angle 151 (FIG. 6) of the primary swirler oxidizer outlet orifices 107. In addition, while both the aft wall oxidizer inlet orifices 106 and the primary swirler oxidizer outlet orifices 107 are shown as being equally spaced, both radially and circumferentially, the radial distance and the angle among individual ones of the aft wall oxidizer inlet orifices 106 and the primary swirler oxidizer outlet orifices 107 may be varied instead.

The swirler ferrule plate 91 of FIGS. 8 and 9 is also seen to include at least one oxidizer outlet orifice 108. The at least one oxidizer outlet orifice 108 provides fluid communication between the annular cavity 110 and the primary swirler venturi region 102. In these figures, a plurality of oxidizer outlet orifices 108 are included in the swirler ferrule plate 91. The plurality of oxidizer outlet orifices 108 in FIGS. 8 and 9 are shown as generally cylindrical holes through the aft wall 118. However, the oxidizer outlet orifices 108 need not be cylindrical holes, but may be other shapes instead, such as a triangular shaped orifice, a rectangular shaped orifice, a trapezoidal shaped orifice, an oval shaped orifice, etc. In addition, similar to the ferrule oxidizer inlet orifices 109, the oxidizer outlet orifices 108 may be tapered. For example, the oxidizer outlet orifices 108 may have a smaller size on the inlet end of the orifice (i.e., the inlet side of the outlet orifice at a forward surface 146 of the aft wall 118) and have a larger size on the outlet end of the orifice (i.e., the outlet side of the outlet orifice at the aft wall downstream side 136 (aft surface) of the aft wall 118). Alternatively, the oxidizer outlet orifices 108 may have a larger size on the inlet end of the orifice and have a smaller size on the outlet end of the orifice.

The oxidizer outlet orifices 108 in FIG. 8 are shown to be disposed at an outlet orifice radial angle 126. The outlet orifice radial angle 126 is shown extending at a radially inward angle from the forward surface 146 of the aft wall 118 to the aft surface 136 of the aft wall 118. The outlet orifice radial angle 126 is to provide the flow of the oxidizer from the annular cavity 110 into the primary swirler venturi region 102 in a radially inward direction toward a tip 93 (FIG. 4) of the fuel nozzle 90. The outlet orifice radial angle 126 is shown with respect to the swirler assembly centerline 69, and may range from zero degrees (i.e., an outlet orifice that is aligned axially parallel with the swirler assembly centerline 69) to seventy degrees.

Referring again to FIG. 9, an arrangement of the oxidizer outlet orifices 108 through the aft surface 136 of the aft wall 118 is shown. Referring briefly back to FIG. 8, towards the top portion of the figure, the oxidizer outlet orifice 108 is shown at an outlet orifice radial angle 126 with respect to the swirler assembly centerline 69. The oxidizer outlet orifice 108 shown in FIG. 8 is represented in FIG. 9 by the oxidizer outlet orifice 108(*a*). However, the oxidizer outlet orifices 108 may further be arranged at an outlet orifice circumferential angle 138. That is, the oxidizer outlet orifices 108 may be aligned at both the outlet orifice radial angle 126 and the outlet orifice circumferential angle 138 (see, e.g., oxidizer outlet orifice 108(*b*)) so as to provide the flow of oxidizer from the annular cavity 110 to the primary swirler venturi region 102 both radially inward and circumferentially about the swirler assembly centerline 69. In FIG. 9, the swirl direction of the oxidizer outlet orifice 108(*b*) would be in a counter-clockwise direction about swirler assembly centerline 69. However, the outlet orifice circumferential angle 138 may be opposite to that shown in FIG. 9 so as to provide the flow of the oxidizer in a clockwise direction about swirler assembly centerline 69. Whether the outlet orifice circumferential angle 138 provides for a clockwise flow of the oxidizer or a counter-clockwise flow of the oxidizer, the direction may be arranged so as to be in either a co-swirl direction with the primary swirl direction 104 or a counter-swirl direction with the primary swirl direction 104 (see, FIG. 4) of the oxidizer provided by the primary swirler 70 in the primary swirler venturi region 102.

FIG. 9 also depicts an arrangement where multiple rows of oxidizer outlet orifices 108 may be included in the swirler ferrule plate 91. For example, a first row 140 of the oxidizer outlet orifices 108, and a second row 144 of the oxidizer outlet orifices 108 may be included in the swirler ferrule plate 91. The first row 140 of the oxidizer outlet orifices 108 may be arranged circumferentially at a radial distance 142 from the swirler assembly centerline 69, while the second row 144 of the oxidizer outlet orifices 108 may be arranged at a different radial distance 145 from the swirler assembly centerline 69. The oxidizer outlet orifices 108 of the first row 140 may be circumferentially equally spaced apart from one another by an angular distance 152. The oxidizer outlet orifices 108 of the second row 144 may be similar circumferentially equally spaced apart by an angular distance 154. Of course, the oxidizer outlet orifices 108 of either the first row 140 or the second row 144 need not be circumferentially equally spaced, and may have a different angular distance 152 between individual oxidizer outlet orifices 108 within each row, and a different angular distance 154 between individual oxidizer outlet orifices 108 within each row. In addition, the oxidizer outlet orifices 108 of the first row 140 may be staggered (i.e., offset) with respect to the oxidizer outlet orifices 108 of the second row 144. For example, utilizing reference line 148 connecting swirler assembly centerline 69 and a center of one of the oxidizer outlet orifices 108 of the second row 144 (e.g., center of oxidizer outlet orifice 108(*a*)), the oxidizer outlet orifices 108 of the first row 140 may be circumferentially offset by an offset angle 150 with respect to the oxidizer outlet orifices 108 of the second row 144.

Figure 11:
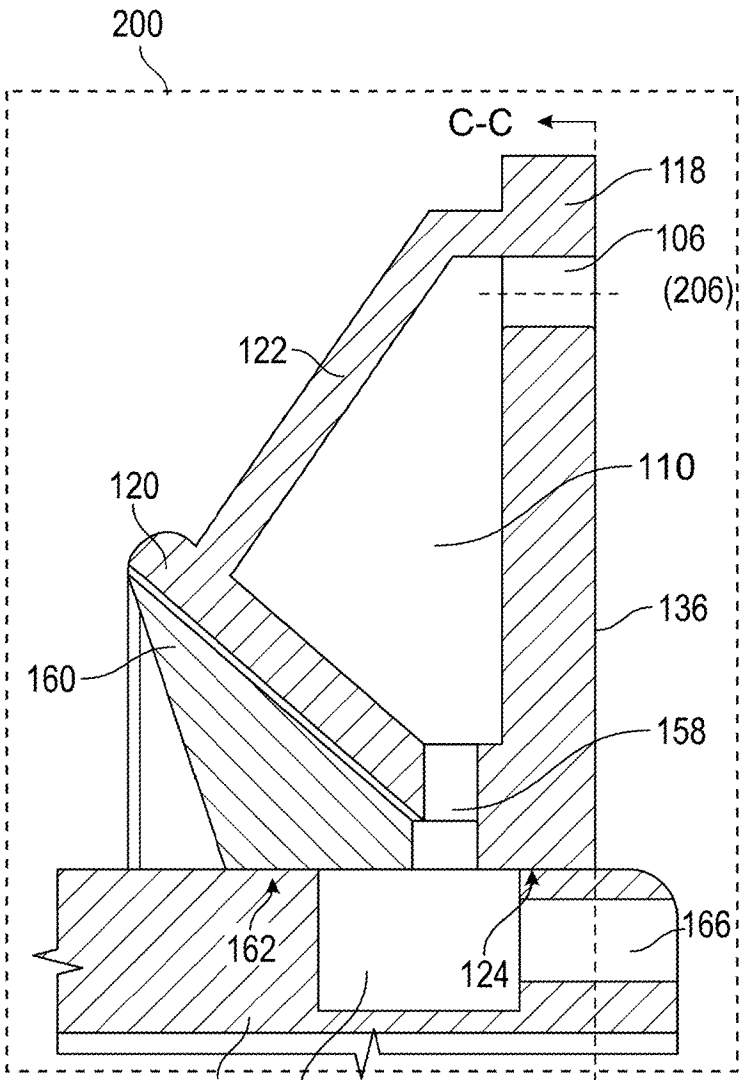
FIG. 11 is a partial cross-sectional side detail view of an alternate exemplary swirler ferrule plate outlet orifice arrangement taken at detail 200 of FIG. 4, according to still another aspect of the present disclosure.
Figure 10:
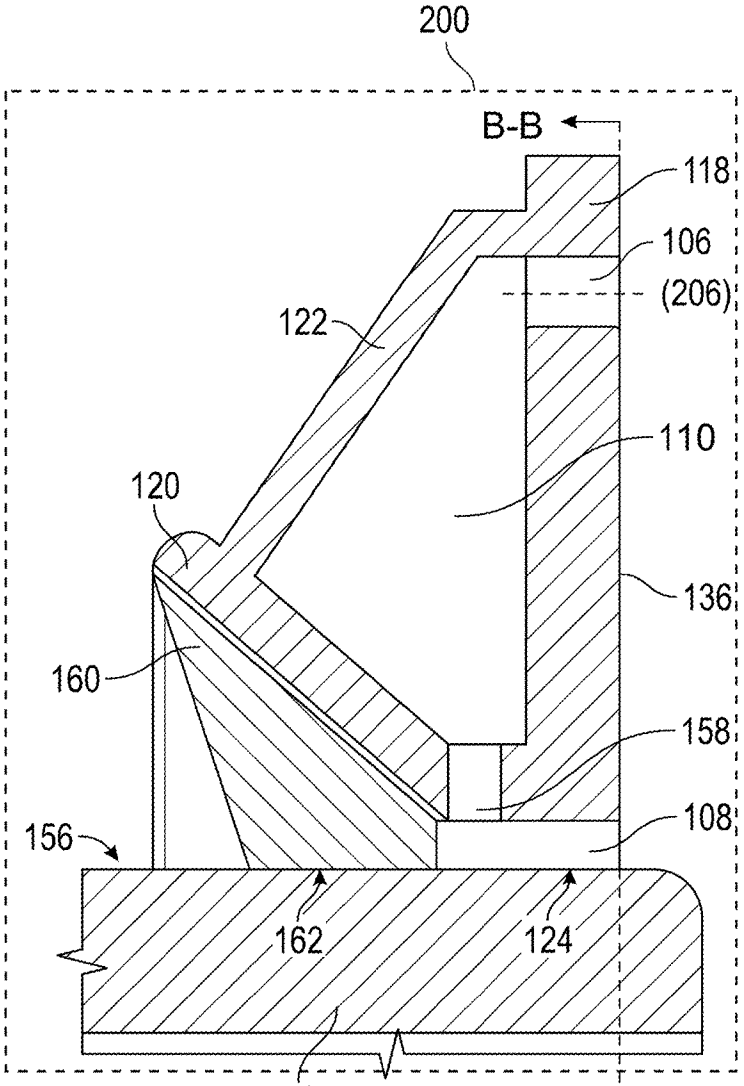
FIG. 10 is a partial cross-sectional side detail view of an alternate exemplary swirler ferrule plate outlet orifice arrangement taken at detail 200 of FIG. 4, according to another aspect of the present disclosure.
Figure 12:
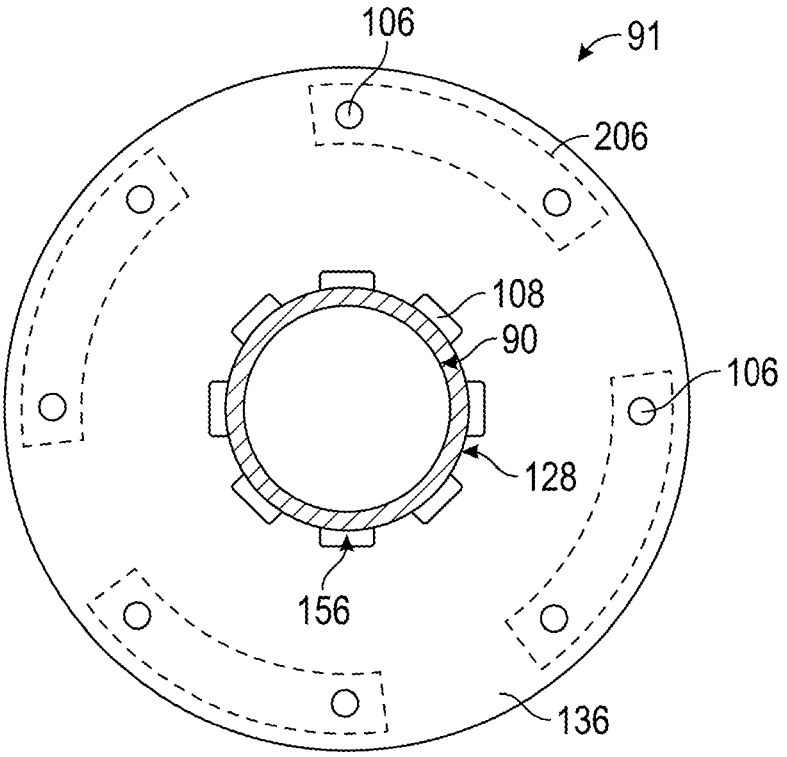
FIG. 12 is a partial cross-sectional forward-looking view taken at plane A-A of FIG. 4 of a swirler ferrule plate and fuel nozzle outlet orifice arrangement for the aspect of FIG. 10, according to yet another aspect of the present disclosure.
Figure 13:
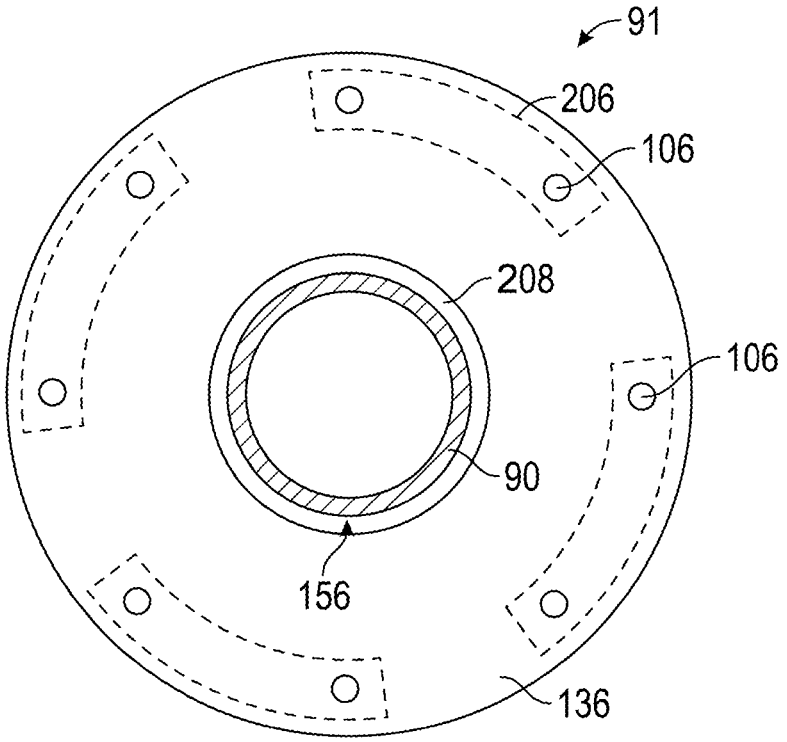
FIG. 13 is a partial cross-sectional forward-looking view taken at plane A-A of FIG. 4 of a swirler ferrule plate and fuel nozzle outlet orifice arrangement for the aspect of FIG. 10, according to yet another aspect of the present disclosure.

FIGS. 10 to 14 depict additional arrangements of the oxidizer outlet orifices 108 according to aspects of the present disclosure. FIG. 10 is a partial cross-sectional view of an alternate arrangement taken at detail 200 of FIG. 4. In FIG. 10, the oxidizer outlet orifice 108 is shown to be located through the aft wall 118 at the fuel nozzle opening 124. That is, the oxidizer outlet orifice 108 is formed between a fuel nozzle outer surface 156 of the fuel nozzle 90 and the swirler ferrule plate 91 at the fuel nozzle opening 124. FIG. 12 is a partial cross-sectional view taken at plane A-A of FIG. 4 for the aspect shown in FIG. 10. In FIG. 12, the oxidizer outlet orifices 108 of this arrangement can be seen to be formed as a rectangular shaped outlet orifice, or a slot formed through the fuel nozzle opening 124 of the swirler ferrule plate 91. Thus, the fuel nozzle outer surface 156 of the fuel nozzle 90 defines the radially inner portion of the oxidizer outlet orifice 108. Of course, as with the previous aspects of the present disclosure described above, the oxidizer outlet orifices 108 are not limited to being rectangular shaped, and other shapes may be implemented instead. In addition, the number, size, and spacing of the rectangular oxidizer outlet orifices 108 may be varied similar to that described above. Moreover, while FIG. 12 depicts multiple rectangular shaped outlet orifices 108 circumferentially spaced about the fuel nozzle opening 124, FIG. 13, which is taken at plane A-A of FIG. 4, depicts an exemplary aspect of the present disclosure where a single circumferential or annular oxidizer outlet orifice 208 or slot may be implemented, instead of the multiple oxidizer outlet orifices 108.

Referring back to FIG. 10, to provide for fluid communication between the annular cavity 110 and the oxidizer outlet orifice 108, a channel 158 is included in the swirler ferrule plate 91 extending through a radially inward portion of the annular conical wall 120 at the aft wall 118. A radially inward portion of the channel 158 defines a portion of the oxidizer outlet orifice 108. In this aspect, to provide support for the annular conical wall 120, and to seal off the forward side of the annular cavity 110 where the channel 158 is formed, a support rib 160 may be included as part of the swirler ferrule plate 91. An inner surface 162 of the support rib 160 forms a part of the fuel nozzle opening 124 of the swirler ferrule plate where the oxidizer outlet orifice 108 is formed. The support rib 160 may be formed as a portion of an annular wall about the circumference of the swirler assembly centerline 69 where the oxidizer outlet orifice 108 is formed. Thus, with this aspect, a flow path for the flow of the oxidizer from the annular cavity 110 to the primary swirler venturi region 102 is through the channel 158 and, then, the oxidizer outlet orifice 108. Again, the size, number, and arrangement of the foregoing flow path elements can be arranged to obtain a desired pressure drop $\Delta P_3$. In addition, in the FIG. 13 aspect where an annular outlet orifice may be implemented as the oxidizer outlet orifice 108, the channel 158 may constitute an annular channel about the entire circumference of the fuel nozzle opening 124.

Figure 14:
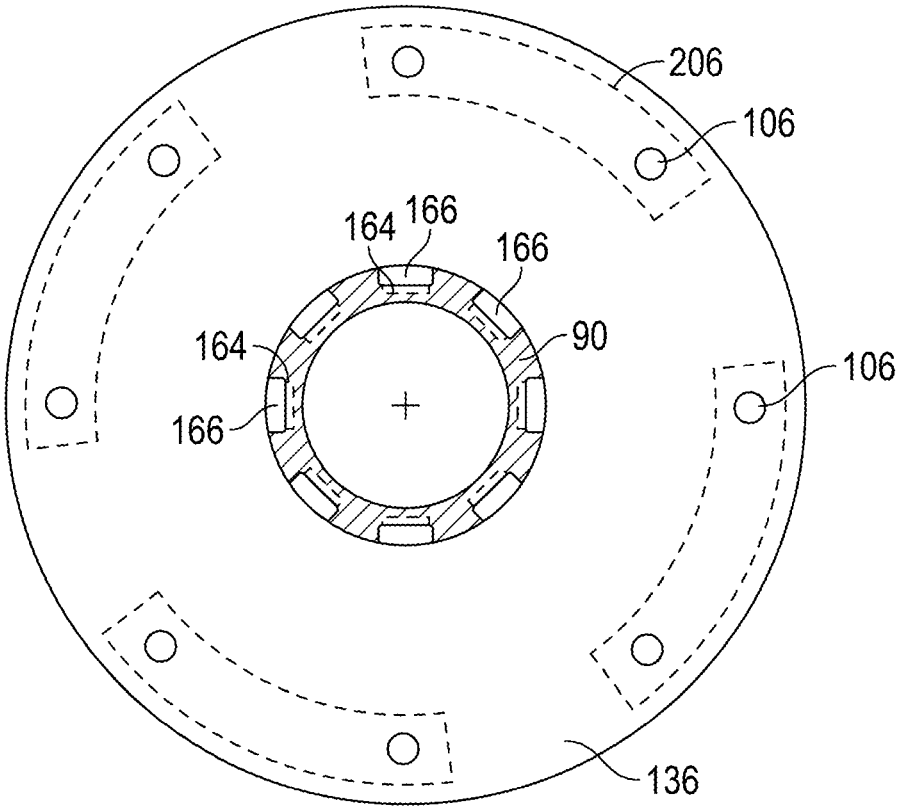
FIG. 14 is a partial cross-sectional aft forward-looking view taken at plane A-A of FIG. 4 of a swirler ferrule plate and fuel nozzle outlet orifice arrangement for the aspect of FIG. 11, according to still another aspect of the present disclosure.

FIG. 11, which is also taken at detail 200 of FIG. 4, depicts another arrangement of the oxidizer outlet orifices according to an aspect of the present disclosure. The FIG. 11 aspect is somewhat similar to that of FIG. 10 in that it includes the channel 158 and the support rib 160, but the oxidizer outlet orifice 108 is not formed through the aft wall 118 at the fuel nozzle outer surface 156. Rather, the fuel nozzle 90 includes a fuel nozzle cavity 164 formed in a radially outer portion of the fuel nozzle, and a fuel nozzle oxidizer outlet orifice 166. The fuel nozzle oxidizer outlet orifice 166 provides fluid communication between the fuel nozzle cavity 164 and the primary swirler venturi region 102. As seen in FIG. 14, which is taken at plane A-A of FIG. 4, multiple fuel nozzle cavities 164 and a corresponding fuel nozzle oxidizer outlet orifice 166 may be provided about the circumference of the fuel nozzle 90. Alternatively, and similar to the arrangement depicted in FIG. 13, the fuel nozzle cavity 164 and/or the fuel nozzle oxidizer outlet orifice 166 may be formed as an annular fuel nozzle cavity and an annular outlet orifice about the entire circumference of the fuel nozzle 90. In this case, the channel 158 may also be formed about the entire circumference of the fuel nozzle opening 124. Thus, the flow of oxidizer in FIG. 11 is from the annular cavity 110 through the channel 158 into the fuel nozzle cavity 164 and, then, exiting through the fuel nozzle oxidizer outlet orifice 166 into the primary swirler venturi region 102. These elements together form an oxidizer outlet orifice.

Figure 15:
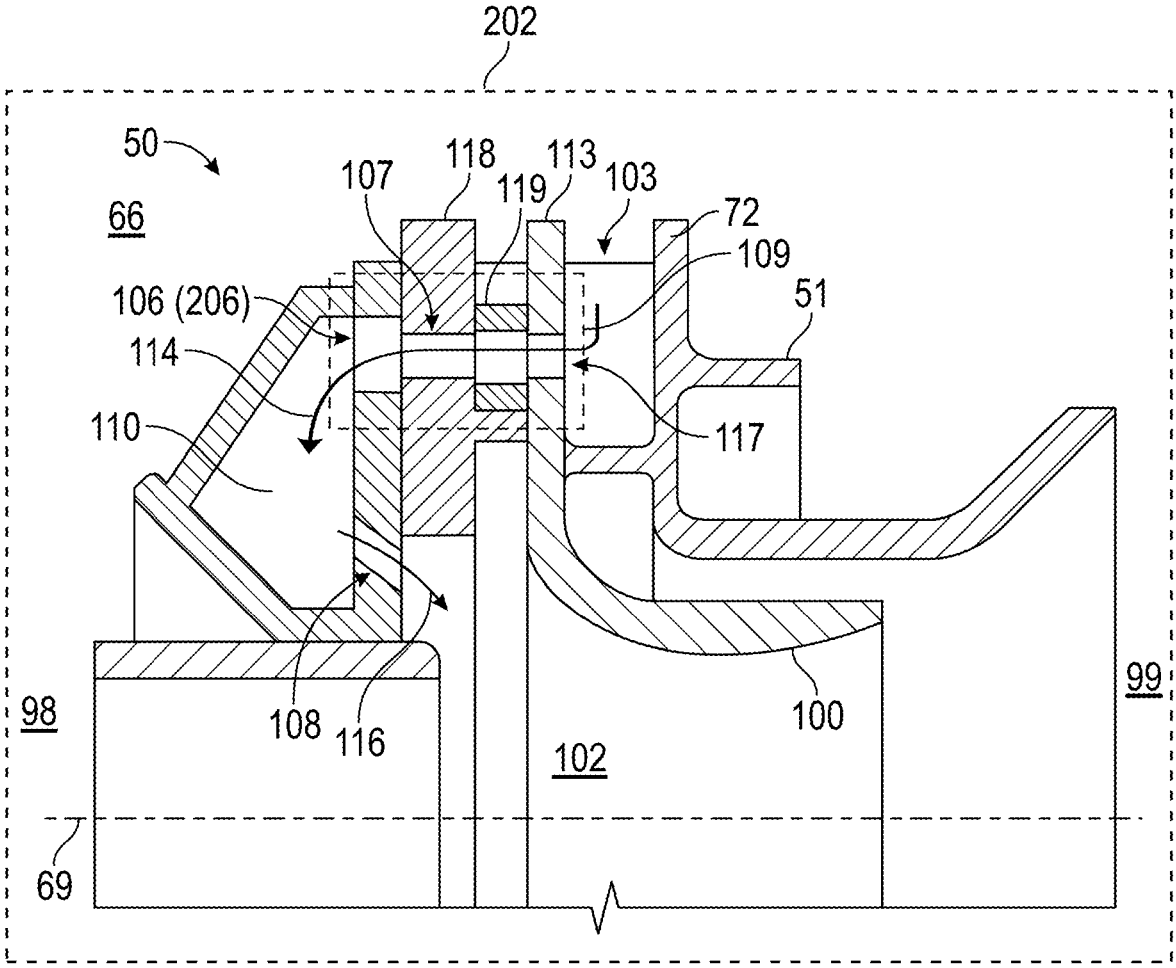
FIG. 15 is a partial cross-sectional side detail view of a secondary swirler outlet orifice arrangement taken at detail 202 of FIG. 4, according to an aspect of the present disclosure.

FIG. 15, which is taken at detail 202 of FIG. 4, depicts another aspect of the present disclosure relating to the ferrule oxidizer inlet orifice 109. In the previously discussed aspects, the primary swirler 70 included the primary swirler oxidizer outlet orifice 107 that, together with the aft wall oxidizer inlet orifice 106 formed a ferrule oxidizer inlet orifice 109 that provides fluid communication between the primary swirler 70 and the annular cavity 110. The third flow 114 of the oxidizer was from the primary swirler 70 through the ferrule oxidizer inlet orifice 109 to the annular cavity 110. In the FIG. 15 aspect, the third flow 114 of oxidizer is provided to the annular cavity 110 from the secondary swirler 72 rather than from the primary swirler 70. Thus, as seen in FIG. 15, secondary swirler forward wall 113, which also forms an aft wall of the primary swirler 70, includes a plurality of secondary swirler oxidizer outlet orifices 117 therethrough. A plurality of flow tubes 119 are provided within the primary swirler 70 so as to connect the secondary swirler oxidizer outlet orifices 117 with the primary swirler oxidizer outlet orifices 107. Thus, in the present aspect, a respective secondary swirler oxidizer outlet orifice 117, flow tube 119, primary swirler oxidizer outlet orifice 107, and aft wall oxidizer inlet orifice 106, together form the ferrule oxidizer inlet orifice 109.

In operation, this aspect is similar to the above aspects where the oxidizer is provided through the primary swirler. More specifically, the second flow 103 of oxidizer from the pressure plenum 66 is provided to the secondary swirler 72, where the first pressure drop $\Delta P_1$ is incurred. The third flow 114 occurs from the secondary swirler 72 through the ferrule oxidizer inlet orifice 109 (now comprised of 117, 119, 107 and 106), where the second pressure drop $\Delta P_2$ is incurred. The remaining fourth flow 116, where the third pressure drop $\Delta P_3$ is incurred, is the same as the above aspects.

Of course, the present disclosure is not limited to only the aspect where the ferrule oxidizer inlet orifice 109 is as shown in FIG. 4 (i.e., flow from the primary swirler to the annular cavity) or where the ferrule oxidizer inlet orifice 109 is as shown in FIG. 15 (i.e., flow from the secondary swirler to the annular cavity). Rather, a combination of the two aspects may be implemented in the same swirler assembly. For example, when eight primary swirler oxidizer outlet orifices 107 are provided, as shown in FIG. 6, four of them may implement the FIG. 4 ferrule oxidizer inlet orifice 109 arrangement, and the other four of them may implement the FIG. 15 ferrule oxidizer inlet orifice 109 arrangement.

Figure 16:
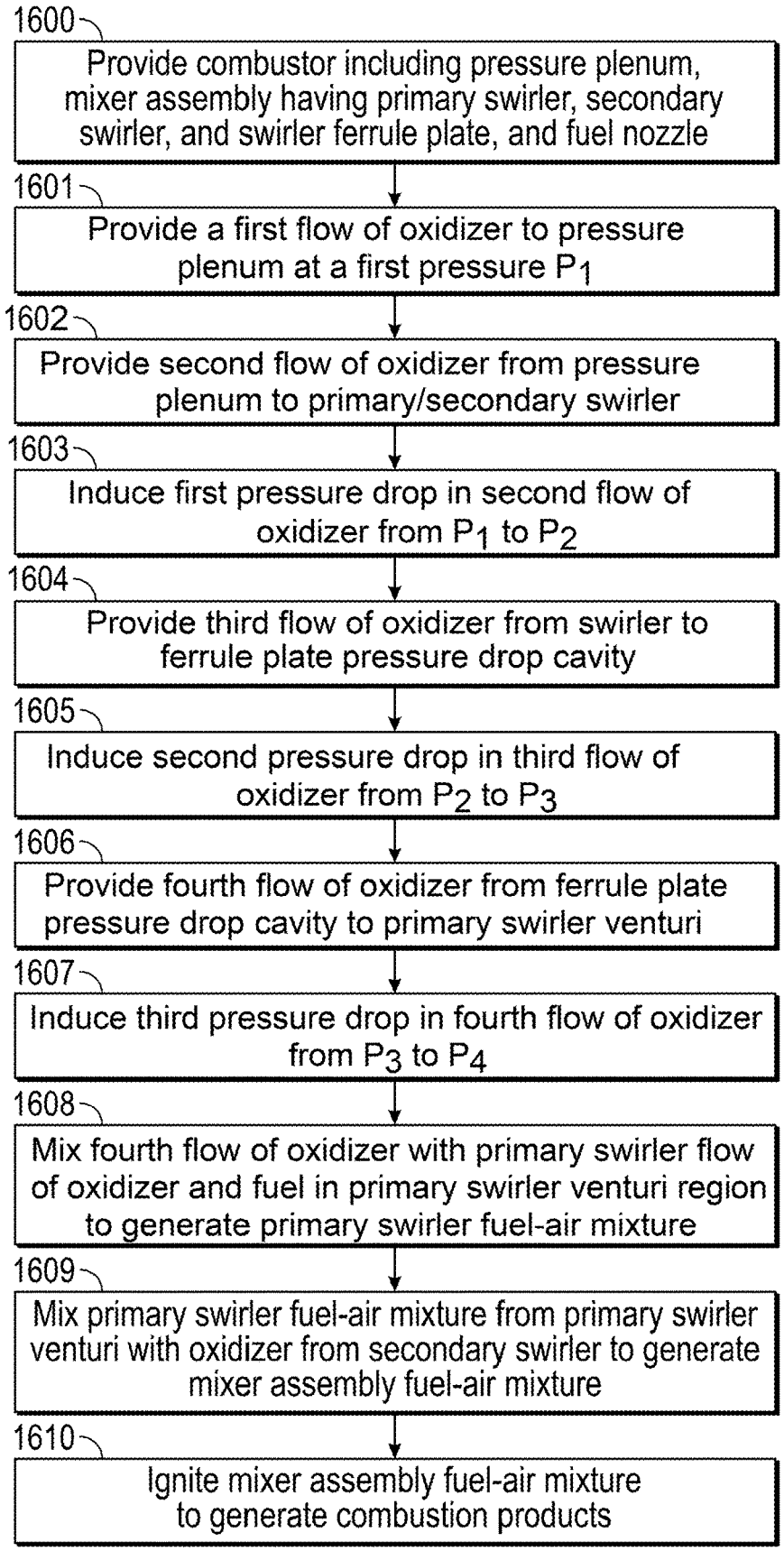
FIG. 16 is a flowchart of process steps for a method of operating a combustor, according to an aspect of the present disclosure.

Another aspect of the present disclosure relates to a method of operating a combustor of a gas turbine engine. FIG. 16 depicts a flowchart of process steps for the method of this aspect of the disclosure. In step 1600, a combustor 26 is provided. The combustor includes various components such as i) the pressure plenum 66, and ii) the swirler assembly 50 including a) the swirler 51 having the primary swirler 70 with the primary swirler venturi 100, and the secondary swirler 72, b) the swirler ferrule plate 91 connected to the primary swirler 70 and including the fuel nozzle opening 124 extended therethrough, and an annular pressure drop cavity 110. The annular pressure drop cavity 110 has the plurality of aft wall oxidizer inlet orifices 106 and the primary swirler 70 has the plurality of primary swirler oxidizer outlet orifices 107, together forming a plurality of ferrule oxidizer inlet orifices 109, each in fluid communication with the primary swirler 70. Alternatively, the secondary swirler may include the secondary swirler oxidizer outlet orifices 117 and the flow tube 119 may be included in the primary swirler to form the ferrule oxidizer inlet orifice 109 in fluid communication with the secondary swirler 72. The annular pressure drop cavity 110 also includes the at least one oxidizer outlet orifice 108 in fluid communication with the primary swirler venturi region 102. The swirler assembly 50 further includes the fuel nozzle 90 disposed in the fuel nozzle opening 124 of the swirler ferrule plate 91. The structure and arrangement of the any of the foregoing combustor components may be any of those described above with regard to FIGS. 1 through 15.

Once the combustor 26 according to the present disclosure has been provided, the remaining operational processes for operating the combustor are performed. As can be readily understood, the following processes of the method are performed via operation of the engine 10. In step 1601, a first flow 94 (FIG. 2) of oxidizer is provided to the pressure plenum 66, where the first flow 94 of oxidizer has a first pressure $P_1$. This process was described above where, in operation, engine 10 takes in air 73 and a portion of the air 73 enters the compressor section as compressor inlet air flow 80 where it is compressed, and, then, compressed air 82 is provided via a diffuser (not shown) to the combustor 26, where a portion of the air 82(*a*) enters the pressure plenum 66 as the first flow 94.

Next, in step 1602, a second flow 101 (or 103) of the oxidizer is provided from the pressure plenum 66 to the swirler 51. In the aspect where the flow is through the primary swirler 70, the second flow of step 1602 is the second flow 101. In the aspect where the flow is through the secondary swirler 72, the second flow of step 1602 is the second flow 103. In step 1603, a first pressure drop $\Delta P_1$ is induced into the second flow 101 of the oxidizer (or into the second flow 103 of the oxidizer) from the pressure $P_1$ to the pressure $P_2$. A third flow 114 of the oxidizer is then provided in step 1604 from the swirler 50 (i.e., either from the primary swirler 70 or from the secondary swirler 72) to the annular pressure drop cavity 110 of the swirler ferrule plate 91 via the plurality of ferrule oxidizer inlet orifices 109. In step 1605, a second pressure drop $\Delta P_2$ is induced in the third flow 114 of the oxidizer through the ferrule oxidizer inlet orifices 109 to the annular pressure drop cavity 110, where the second pressure drop is from the second pressure $P_2$ to a third pressure $P_3$ lower than the second pressure.

In step 1606, a fourth flow 116 of the oxidizer is provided from the annular pressure drop cavity 110 to a primary swirler venturi region 102 via the at least one oxidizer outlet orifice 108 of the swirler ferrule plate 91. A third pressure drop $\Delta P_3$ is induced in the fourth flow 116 of the oxidizer through the at least one outlet orifice of the swirler ferrule plate 91 (step 1607) from the third pressure $P_3$ to a fourth pressure $P_4$ lower than the third pressure. The second pressure drop $\Delta P_2$ and the third pressure drop $\Delta P_3$ form a total pressure drop $\Delta P_{TFP}$ through the swirler ferrule plate 91. The second pressure drop $\Delta P_2$ may provide between ten and ninety percent of the total pressure drop $\Delta P_{TFP}$, while the third pressure drop $\Delta P_3$ may provide the remaining portion of the total pressure drop $\Delta P_{TFP}$.

Next, in step 1608, the fourth flow 116 of the oxidizer into the primary swirler venturi region 102 is mixed with the swirled oxidizer flow from the primary swirler 70. Fuel 92 is also injected into the primary swirler venturi region 102 of the primary swirler venturi 100 by the fuel nozzle 90. The fuel 92 mixes with the fourth flow 116 of the oxidizer and the swirled oxidizer flow from the primary swirler 70 to generate a primary swirler fuel-air mixture. The primary swirler fuel-air mixture travels toward the downstream end 99 of the swirler assembly through the primary swirler venturi 100. The primary swirler fuel-air mixture is then mixed with a swirled oxidizer from the secondary swirler 72 in a flare cone downstream of the primary swirler venturi 100 to generate a swirler assembly fuel-air mixture (step 1609). The swirler assembly fuel-air mixture is then ignited in the combustion chamber 62 to form combustion products 86 (step 1610).

While the foregoing description relates generally to a gas turbine engine, it can readily be understood that the gas turbine engine may be implemented in various environments. For example, the engine may be implemented in an aircraft, but may also be implemented in non-aircraft applications such as power generating stations, marine applications, or oil and gas production applications. Thus, the present disclosure is not limited to use in aircraft.

Further aspects of the present disclosure are provided by the subject matter of the following clauses.

A swirler assembly of a combustor, the swirler assembly defining a swirler assembly centerline therethrough, the swirler assembly comprising: a swirler including (a) a primary swirler and (b) a secondary swirler, the primary swirler including (i) a primary swirler venturi, and (ii) a primary swirler forward wall extending radially outward from, and circumferentially about the swirler assembly centerline, and (iii) a plurality of primary swirler oxidizer outlet orifices extending through the primary swirler forward wall, a swirler ferrule plate connected to an upstream side of the primary swirler forward wall and including a fuel nozzle opening extended therethrough along the swirler assembly centerline, and a fuel nozzle disposed in the fuel nozzle opening of the swirler ferrule plate, the swirler ferrule plate comprising: (a) an aft wall extending radially outward from the fuel nozzle opening and including a plurality of aft wall oxidizer inlet orifices extending through the aft wall, (b) an annular conical wall extending from a radially inward portion of the aft wall at the fuel nozzle opening, and extending radially outward upstream from the aft wall; and (c) an annular cavity wall connecting a radially outward portion of the aft wall and an upstream end of the annular conical wall, an annular cavity being formed between the aft wall, the annular conical wall and the annular cavity wall, wherein respective ones of the plurality of primary swirler oxidizer outlet orifices are arranged with corresponding respective ones of the plurality of aft wall oxidizer inlet orifices in fluid communication therewith to define respective ones of a plurality of ferrule oxidizer inlet orifices, wherein each of the plurality of ferrule oxidizer inlet orifices provide fluid communication between the swirler assembly and the annular cavity of the swirler ferrule plate, wherein the swirler ferrule plate includes at least one oxidizer outlet orifice providing fluid communication between the annular cavity and the primary swirler venturi, wherein a first flow of is provided to a pressure plenum on an upstream side of the swirler assembly, a second flow of the oxidizer provided from the pressure plenum into the swirler assembly incurs a first pressure drop from a first pressure of the pressure plenum to a second pressure lower than the first pressure, wherein a third flow of the oxidizer from the swirler assembly through the plurality of ferrule oxidizer inlet orifices into the annular cavity incurs a second pressure drop from the second pressure to a third pressure lower than the second pressure, and wherein a fourth flow of the oxidizer from the annular cavity through the at least one oxidizer outlet orifice into the primary swirler venturi incurs a third pressure drop from the third pressure to a fourth pressure lower than the second pressure.

The swirler assembly according to any preceding clause, wherein the at least one oxidizer outlet orifice comprises a plurality of oxidizer outlet orifices arranged axially through the aft wall with respect to the swirler assembly centerline.

The swirler assembly according to any preceding clause, wherein the at least one oxidizer outlet orifice comprises a plurality of oxidizer outlet orifices arranged through the aft wall at a radially inward angle with respect to the swirler assembly centerline, from an upstream side of the aft wall to a downstream side of the aft wall, so as to direct the fourth flow of oxidizer therethrough toward a tip of the fuel nozzle.

The swirler assembly according to any preceding clause, wherein the plurality of the oxidizer outlet orifices are further arranged at an angle circumferentially in a co-swirl direction with a swirl direction of the primary swirler.

The swirler assembly according to any preceding clause, wherein the second pressure drop comprises between ten and ninety percent of a total pressure drop through the swirler ferrule plate, and the third pressure drop comprises a remaining portion of the total pressure drop through the swirler ferrule plate.

The swirler assembly according to any preceding clause, wherein the at least one oxidizer outlet orifice comprises a plurality of oxidizer outlet orifices each defined adjacent to the fuel nozzle, wherein an outer surface of the fuel nozzle defines a portion of each oxidizer outlet orifice.

The swirler assembly according to any preceding clause, wherein the at least one oxidizer outlet orifice comprises a plurality of oxidizer outlet orifices, wherein the fuel nozzle includes a plurality of fuel nozzle cavities on an radially outer portion of the fuel nozzle, each of the plurality of fuel nozzle cavities being in fluid communication with the annular cavity via a respective oxidizer outlet orifice among the plurality of oxidizer outlet orifices, and wherein each fuel nozzle cavity includes a fuel nozzle oxidizer outlet orifice, providing fluid communication between the fuel nozzle cavity and the primary swirler venturi.

The swirler assembly according to any preceding clause, wherein the at least one oxidizer outlet orifice comprises an annular channel defined through the fuel nozzle opening of the swirler ferrule plate, and wherein the fuel nozzle comprises (i) an annular fuel nozzle cavity in a radially outer portion of the fuel nozzle, the annular fuel nozzle cavity being in fluid communication with the annular cavity via the annular channel, and (ii) at least one fuel nozzle oxidizer outlet orifice, providing fluid communication between the annular fuel nozzle cavity and the primary swirler venturi.

The swirler assembly according to any preceding clause, wherein the at least one fuel nozzle oxidizer outlet orifice comprises an annular outlet orifice.

The swirler assembly according to any preceding clause, wherein the at least one oxidizer outlet orifice comprises a plurality of rows of oxidizer outlet orifices circumferentially arranged through the aft wall, each row of the plurality of rows being arranged a different radial distance from the swirler assembly centerline.

The swirler assembly according to any preceding clause, wherein the at least one oxidizer outlet orifice comprises any one of a circular shaped orifice, a rectangular shaped orifice, a triangular shaped orifice, and a trapezoidal shaped orifice.

The swirler assembly according to any preceding clause, wherein the at least one oxidizer outlet orifice is tapered from a first size at a forward surface of the aft wall to a second size at an aft surface of the aft wall, the first size being different from the second size.

The swirler assembly according to any preceding clause, wherein the primary swirler further includes a plurality of primary swirler swirl vanes circumferentially spaced about the swirler assembly centerline, and wherein each one of the plurality of primary swirler oxidizer outlet orifices is through the primary swirler disposed between two successive primary swirler swirl vanes among the plurality of swirl vanes.

The swirler assembly according to any preceding clause, wherein the secondary swirler includes (i) a secondary swirler forward wall extending radially outward from, and circumferentially about the swirler assembly centerline, the secondary swirler forward wall also defining a primary swirler aft wall, and (ii) a plurality of secondary swirler oxidizer outlet orifices extending through the secondary swirler forward wall, wherein the swirler assembly further comprises a plurality of flow tubes, each one of the plurality of flow tubes connecting a respective one of the secondary swirler oxidizer outlet orifices with a respective one of the primary swirler oxidizer outlet orifices, wherein the flow tube further defines the ferrule oxidizer inlet orifice, and wherein the second flow of the oxidizer into the swirler is a flow of the oxidizer into an inlet portion of the secondary swirler.

The swirler assembly according to any preceding clause, wherein each of the plurality of aft wall oxidizer inlet orifices comprises a slotted oxidizer inlet orifice extending through the aft wall circumferentially about the swirler assembly centerline, and wherein one slotted oxidizer inlet orifice among the plurality of slotted oxidizer inlet orifices is arranged with more than one of the plurality of primary swirler oxidizer outlet orifices of the primary swirler.

A method of operating a combustor of a gas turbine, the combustor comprising (a) a pressure plenum, and (b) a swirler assembly including (i) a swirler having a primary swirler with a primary swirler venturi, and a secondary swirler, (ii) a swirler ferrule plate connected to an upstream side of the primary swirler and including a fuel nozzle opening extended therethrough, and an annular pressure drop cavity, the annular pressure drop cavity having a plurality of oxidizer inlet orifices in fluid communication with the swirler assembly, and at least one outlet orifice in fluid communication with the primary swirler venturi, and (iii) a fuel nozzle disposed in the fuel nozzle opening of the swirler ferrule plate, the method comprising: providing a first flow of oxidizer to the pressure plenum, the first flow of oxidizer having a first pressure, providing a second flow of the oxidizer from the pressure plenum to the swirler assembly, the second flow of the oxidizer inducing a first pressure drop from the first pressure to a second pressure lower than the first pressure, providing a third flow of the oxidizer from the swirler assembly to the annular pressure drop cavity of the swirler ferrule plate via the plurality of oxidizer inlet orifices of the annular pressure drop cavity, the second flow of the oxidizer inducing a second pressure drop in the flow of the oxidizer in the annular pressure drop cavity from the second pressure to a third pressure lower than the second pressure, and providing a fourth flow of the oxidizer from the annular pressure drop cavity to the primary swirler venturi via the at least one outlet orifice of the swirler ferrule plate, the fourth flow of the oxidizer inducing a third pressure drop in the flow of the oxidizer from the third pressure to a fourth pressure lower than the third pressure.

The method according to any preceding clause, wherein the primary swirler comprises a primary swirler forward wall having a plurality of primary swirler oxidizer outlet orifices therethrough, wherein respective ones of the plurality of primary swirler oxidizer outlet orifices are in fluid communication with respective ones of the plurality of oxidizer inlet orifices of the annular pressure drop cavity thereby defining a plurality of ferrule oxidizer inlet orifices, and wherein the second flow of the oxidizer into the swirler assembly is a flow of the oxidizer into the primary swirler, and the third flow of the oxidizer is a flow of the oxidizer from the primary swirler to the annular pressure drop cavity via the plurality of ferrule oxidizer inlet orifices.

The method according to any preceding clause, wherein the primary swirler comprises a primary swirler forward wall having a plurality of primary swirler oxidizer outlet orifices therethrough, wherein respective ones of the plurality of primary swirler oxidizer outlet orifices are in fluid communication with respective ones of the plurality of oxidizer inlet orifices of the annular pressure drop cavity thereby defining a plurality of ferrule oxidizer inlet orifices, wherein the secondary swirler is downstream of the primary swirler and includes a plurality of secondary swirler oxidizer outlet orifices through a forward wall of the secondary swirler, wherein the swirler assembly further comprises a plurality of flow tubes, each respective one of the plurality of flow tubes connecting a respective one of the plurality of primary swirler oxidizer outlet orifices with a respective one of the plurality of second swirler oxidizer outlet orifices to thereby further define the plurality of ferrule oxidizer inlet orifices and to provide fluid communication between the secondary swirler and the annular pressure drop cavity, and wherein the second flow of the oxidizer into the swirler assembly is a flow of the oxidizer into the secondary swirler, and the third flow of the oxidizer is a flow of the oxidizer from the secondary swirler to the annular pressure drop cavity via the plurality of ferrule oxidizer inlet orifices.

The method according to any preceding clause, wherein the at least one outlet orifice comprises a plurality of outlet orifices arranged through an aft wall of the swirler ferrule plate, and the fourth flow of the oxidizer is directed by the plurality of outlet orifices radially inward toward a tip of the fuel nozzle.

The method according to any preceding clause, wherein the second pressure drop comprises between ten and ninety percent of a total pressure drop through the swirler ferrule plate, and the third pressure drop comprises a remaining portion of the total pressure drop through the swirler ferrule plate.

The method according to any preceding clause, wherein the at least one outlet orifice comprises a plurality of outlet orifices each defined at the fuel nozzle opening of the swirler ferrule plate, and wherein an outer surface of the fuel nozzle forms a radially inward portion of each the outlet orifices.

Although the foregoing description is directed to some exemplary embodiments of the present disclosure, it is noted that other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

We claim:

1. A swirler assembly of a combustor, the swirler assembly defining a swirler assembly centerline therethrough, the swirler assembly comprising:

a swirler including (a) a primary swirler and (b) a secondary swirler, the primary swirler including (i) a primary swirler venturi, and (ii) a primary swirler forward wall extending radially outward from, and circumferentially about the swirler assembly centerline, and (iii) a plurality of primary swirler oxidizer outlet orifices extending through the primary swirler forward wall;

a swirler ferrule plate connected to an upstream side of the primary swirler forward wall and including a fuel nozzle opening extended therethrough along the swirler assembly centerline; and a fuel nozzle disposed in the fuel nozzle opening of the swirler ferrule plate, the swirler ferrule plate comprising:

(a) an aft wall extending radially outward from the fuel nozzle opening and including a plurality of aft wall oxidizer inlet orifices extending through the aft wall;

(b) an annular conical wall extending from a radially inward portion of the aft wall at the fuel nozzle opening, and extending radially outward upstream from the aft wall; and (c) an annular cavity wall connecting a radially outward portion of the aft wall and an upstream end of the annular conical wall, an annular cavity being formed between the aft wall, the annular conical wall and the annular cavity wall, wherein respective ones of the plurality of primary swirler oxidizer outlet orifices are arranged with corresponding respective ones of the plurality of aft wall oxidizer inlet orifices in fluid communication therewith to define respective ones of a plurality of ferrule oxidizer inlet orifices, wherein each of the plurality of ferrule oxidizer inlet orifices provide fluid communication between the swirler and the annular cavity of the swirler ferrule plate, wherein the swirler ferrule plate includes at least one oxidizer outlet orifice providing fluid communication between the annular cavity and the primary swirler venturi, wherein a first flow of oxidizer is provided to a pressure plenum on an upstream side of the swirler assembly, a second flow of the oxidizer provided from the pressure plenum into the swirler incurs a first pressure drop from a first pressure of the pressure plenum to a second pressure lower than the first pressure, wherein a third flow of the oxidizer from the swirler through the plurality of ferrule oxidizer inlet orifices into the annular cavity incurs a second pressure drop from the second pressure to a third pressure lower than the second pressure, and wherein a fourth flow of the oxidizer from the annular cavity through the at least one oxidizer outlet orifice into the primary swirler venturi incurs a third pressure drop from the third pressure to a fourth pressure lower than the third pressure.

2. The swirler assembly according to claim 1, wherein the at least one oxidizer outlet orifice comprises a plurality of oxidizer outlet orifices arranged axially through the aft wall with respect to the swirler assembly centerline.

3. The swirler assembly according to claim 1, wherein the at least one oxidizer outlet orifice comprises a plurality of oxidizer outlet orifices arranged through the aft wall at a radially inward angle with respect to the swirler assembly centerline, from an upstream side of the aft wall to a downstream side of the aft wall, so as to direct the fourth flow of oxidizer therethrough toward a tip of the fuel nozzle.

4. The swirler assembly according to claim 3, wherein the plurality of the oxidizer outlet orifices are further arranged at an angle circumferentially in a co-swirl direction with a swirl direction of the primary swirler.

5. The swirler assembly according to claim 1, wherein the second pressure drop comprises between ten and ninety percent of a total pressure drop through the swirler ferrule plate, and the third pressure drop comprises a remaining portion of the total pressure drop through the swirler ferrule plate.

6. The swirler assembly according to claim 1, wherein the at least one oxidizer outlet orifice comprises a plurality of oxidizer outlet orifices each defined adjacent to the fuel nozzle, wherein an outer surface of the fuel nozzle defines a portion of each oxidizer outlet orifice.

7. The swirler assembly according to claim 1, wherein the at least one oxidizer outlet orifice comprises a plurality of oxidizer outlet orifices, wherein the fuel nozzle includes a plurality of fuel nozzle cavities on a radially outer portion of the fuel nozzle, each of the plurality of fuel nozzle cavities being in fluid communication with the annular cavity via a respective oxidizer outlet orifice among the plurality of oxidizer outlet orifices, and wherein each fuel nozzle cavity includes a fuel nozzle oxidizer outlet orifice, providing fluid communication between the fuel nozzle cavity and the primary swirler venturi.

8. The swirler assembly according to claim 1, wherein the at least one oxidizer outlet orifice comprises an annular channel defined through the fuel nozzle opening of the swirler ferrule plate, and wherein the fuel nozzle comprises (i) an annular fuel nozzle cavity in a radially outer portion of the fuel nozzle, the annular fuel nozzle cavity being in fluid communication with the annular cavity via the annular channel, and (ii) at least one fuel nozzle oxidizer outlet orifice, providing fluid communication between the annular fuel nozzle cavity and the primary swirler venturi.

9. The swirler assembly according to claim 8, wherein the at least one fuel nozzle oxidizer outlet orifice comprises an annular outlet orifice.

10. The swirler assembly according to claim 1, wherein the at least one oxidizer outlet orifice comprises a plurality of rows of oxidizer outlet orifices circumferentially arranged through the aft wall, each row of the plurality of rows being arranged a different radial distance from the swirler assembly centerline.

11. The swirler assembly according to claim 1, wherein the at least one oxidizer outlet orifice comprises any one of a circular shaped orifice, a rectangular shaped orifice, a triangular shaped orifice, and a trapezoidal shaped orifice.

12. The swirler assembly according to claim 1, wherein the at least one oxidizer outlet orifice is tapered from a first size at a forward surface of the aft wall to a second size at an aft surface of the aft wall, the first size being different from the second size.

13. The swirler assembly according to claim 1, wherein the primary swirler further includes a plurality of primary swirler swirl vanes circumferentially spaced about the swirler assembly centerline, and wherein a respective one of the plurality of primary swirler oxidizer outlet orifices through the primary swirler forward wall is disposed between a corresponding two successive primary swirler swirl vanes among the plurality of primary swirler swirl vanes.

14. The swirler assembly according to claim 1, wherein the secondary swirler includes (i) a secondary swirler forward wall extending radially outward from, and circumferentially about the swirler assembly centerline, the secondary swirler forward wall also defining a primary swirler aft wall, and (ii) a plurality of secondary swirler oxidizer outlet orifices extending through the secondary swirler forward wall, wherein the swirler assembly further comprises a plurality of flow tubes, each one of the plurality of flow tubes connecting a respective one of the secondary swirler oxidizer outlet orifices with a respective one of the primary swirler oxidizer outlet orifices, wherein each of the plurality of ferrule oxidizer inlet orifices is defined by a respective secondary swirler oxidizer outlet orifice, a respective flow tube, a respective primary swirler oxidizer outlet orifice, and a respective aft wall oxidizer inlet orifice, and wherein the second flow of the oxidizer into the swirler is a flow of the oxidizer into an inlet portion of the secondary swirler.

15. The swirler assembly according to claim 1, wherein each of the plurality of aft wall oxidizer inlet orifices comprises a slotted oxidizer inlet orifice extending through the aft wall circumferentially about the swirler assembly centerline, and wherein one slotted oxidizer inlet orifice among the plurality of aft wall oxidizer inlet orifices is arranged with more than one of the plurality of primary swirler oxidizer outlet orifices of the primary swirler.

16. A method of operating a combustor of a gas turbine, the combustor comprising (a) a pressure plenum, and (b) a swirler assembly defining a swirler assembly centerline therethrough, the swirler assembly including (i) a swirler having (1) a primary swirler with a primary swirler venturi and a primary swirler forward wall extending radially outward from, and circumferentially about, the swirler assembly centerline, and a plurality of primary swirler oxidizer outlet orifices extending through the primary swirler forward wall, and (2) a secondary swirler, (ii) a swirler ferrule plate connected to an upstream side of the primary swirler forward wall and including (1) a fuel nozzle opening extended therethrough along the swirler assembly centerline, (2) an aft wall extending radially outward from the fuel nozzle opening and including a plurality of aft wall oxidizer inlet orifices extending through the aft wall, (3) an annular conical wall extending from a radially inward portion of the aft wall at the fuel nozzle opening, and extending radially outward upstream from the aft wall, and (4) an annular cavity wall connecting a radially outward portion of the aft wall and an upstream end of the annular conical wall, an annular cavity being formed between the aft wall, the annular conical wall, and the annular cavity wall, and (iii) a fuel nozzle disposed in the fuel nozzle opening of the swirler ferrule plate, wherein respective ones of the plurality of primary swirler oxidizer outlet orifices are arranged with corresponding respective ones of the plurality of aft wall oxidizer inlet orifices in fluid communication therewith to define respective ones of a plurality of ferrule oxidizer inlet orifices, wherein each of the plurality of ferrule oxidizer inlet orifices provide fluid communication between the swirler and the annular cavity of the swirler ferrule plate, and wherein the swirler ferrule plate includes at least one oxidizer outlet orifice providing fluid communication between the annular cavity and the primary swirler venturi, the method comprising:

providing a first flow of oxidizer to the pressure plenum on an upstream side of the swirler assembly, the pressure plenum having a first pressure;

providing a second flow of the oxidizer from the pressure plenum into the swirler, the second flow of the oxidizer incurring a first pressure drop from the first pressure to a second pressure lower than the first pressure;

providing a third flow of the oxidizer from the swirler through the plurality of ferrule oxidizer inlet orifices into the annular cavity of the swirler ferrule plate, the third flow of the oxidizer incurring a second pressure drop in the flow of the oxidizer in the annular cavity from the second pressure to a third pressure lower than the second pressure; and providing a fourth flow of the oxidizer from the annular cavity through the at least one oxidizer outlet orifice of the swirler ferrule plate to the primary swirler venturi, the fourth flow of the oxidizer incurring a third pressure drop in the flow of the oxidizer from the third pressure to a fourth pressure lower than the third pressure.

17. The method according to claim 16, wherein the second flow of the oxidizer into the swirler assembly flows into the primary swirler, and the third flow of the oxidizer flows from the primary swirler to the annular cavity.

18. The method according to claim 16, wherein the secondary swirler is downstream of the primary swirler and includes a plurality of secondary swirler oxidizer outlet orifices through a forward wall of the secondary swirler, wherein the swirler assembly further comprises a plurality of flow tubes, each respective one of the plurality of flow tubes connecting a respective one of the plurality of primary swirler oxidizer outlet orifices with a respective one of the plurality of secondary swirler oxidizer outlet orifices to thereby further define the plurality of ferrule oxidizer inlet orifices and to provide fluid communication between the secondary swirler and the annular cavity, and wherein the second flow of the oxidizer into the swirler assembly flows into the secondary swirler, and the third flow of the oxidizer flows is a flow of the oxidizer from the secondary swirler to the annular cavity via the plurality of ferrule oxidizer inlet orifices.

19. The method according to claim 16, wherein the at least one oxidizer outlet orifice comprises a plurality of oxidizer outlet orifices arranged through an aft wall of the swirler ferrule plate, and the fourth flow of the oxidizer is directed by the plurality of oxidizer outlet orifices radially inward toward a tip of the fuel nozzle.

20. The method according to claim 16, wherein the second pressure drop comprises between ten and ninety percent of a total pressure drop through the swirler ferrule plate, and the third pressure drop comprises a remaining portion of the total pressure drop through the swirler ferrule plate.

* * * * *